US011695239B2

(12) United States Patent
Zhu et al.

(10) Patent No.: US 11,695,239 B2
(45) **Date of Patent: *Jul. 4, 2023**

(54) ELECTRICAL CONNECTOR AND ELECTRICAL CONNECTOR ASSEMBLY

(71) Applicant: LOTES CO., LTD, Keelung (TW)

(72) Inventors: Song Liang Zhu, Keelung (TW); Lun Cai, Keelung (TW)

(73) Assignee: LOTES CO., LTD, Keelung (TW)

( * ) Notice: Subject to any disclaimer, the term of this patent is extended or adjusted under 35 U.S.C. 154(b) by 210 days.

This patent is subject to a terminal disclaimer.

(21) Appl. No.: 17/400,243

(22) Filed: Aug. 12, 2021

(65) Prior Publication Data

US 2022/0077634 A1 Mar. 10, 2022

(30) Foreign Application Priority Data

Sep. 8, 2020 (CN) ..... 202010932438.9
Oct. 26, 2020 (CN) ..... 202011156458.8

(51) Int. Cl.

| | |
|---|---|
| ***H01R 4/66*** | (2006.01) |
| ***H01R 13/6471*** | (2011.01) |
| ***H01R 13/516*** | (2006.01) |
| ***H01R 13/6582*** | (2011.01) |
| ***H01R 13/6587*** | (2011.01) |

(52) U.S. Cl.
CPC ..... *H01R 13/6471* (2013.01); *H01R 13/516* (2013.01); *H01R 13/6582* (2013.01); *H01R 13/6587* (2013.01)

(58) Field of Classification Search
CPC ..... H01R 13/6461; H01R 13/6471; H01R 13/516; H01R 13/518; H01R 13/6582; H01R 13/6587
USPC ..... 439/79, 108
See application file for complete search history.

(56) References Cited

U.S. PATENT DOCUMENTS 6,280,201 B1 8/2001 Morris
2022/0077634 A1* 3/2022 Zhu ..... H01R 13/514

FOREIGN PATENT DOCUMENTS

| | | |
|---|---|---|
| CN | 101958474 B | 7/2014 |
| CN | 106104933 A | 11/2016 |
| CN | 110021857 A | 7/2019 |
| CN | 105977678 B | 9/2019 |

* cited by examiner

*Primary Examiner* — Khiem M Nguyen
(74) *Attorney, Agent, or Firm* — Locke Lord LLP; Tim Tingkang Xia, Esq.

(57) ABSTRACT

An electrical connector includes multiple electrical modules sequentially stacked along a vertical direction. Each electrical module includes an insulating block being arc-shaped, a row of conductors fixed to the insulating block, and a first shielding member. The row of conductors includes multiple first grounding conductors and multiple pairs of first signal conductors arranged on the insulating block along a left-right direction. The two first signal conductors in a same pair of first signal conductors have a same length. The first shielding member has a first main body portion overlapping with a projection of one pair of first signal conductors in the vertical direction. The first shielding member and each conductor bend and extend downward from a top thereof and backward from a front thereof to be arc-shaped. The first contact portions of the row of conductors located on the same electrical module are located on a same horizontal plane.

15 Claims, 18 Drawing Sheets

200

44

ELECTRICAL CONNECTOR AND ELECTRICAL CONNECTOR ASSEMBLY

CROSS-REFERENCE TO RELATED PATENT APPLICATION

This non-provisional application claims priority to and the benefit of, pursuant to 35 U.S.C. § 119(a), patent application Serial No. CN202010932438.9 filed in China on Sep. 8, 2020, and patent application Serial No. CN202011156458.8 filed in China on Oct. 26, 2020. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector and an electrical connector assembly, and particularly to an electrical connector and an electrical connector assembly for transmitting high frequency signals.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An existing backplate electrical connector includes a plurality of electrical modules formed in multiple rows and provided to be stacked along a left-right direction. Each electrical module includes an insulating body, and a plurality of pairs of differential signal terminals fixed to the insulating body and arranged in a row along the vertical direction. Each differential signal terminal includes a contact portion to be electrically connected to a mating connector, a conductive portion perpendicular to the contact portion and mounted on a circuit board, and a connecting portion bending and extending along the vertical direction and connected between the contact portion and the conductive portion. The two differential signal terminals of each pair of differential signal terminals are arranged to be adjacent in the vertical direction.

However, in the electrical connector, an arranging direction of the two differential signal terminals in each pair of differential signal terminals and a bending direction of the connecting portion are identical, as both are in the vertical direction. Thus, the lengths of the differential signal terminals in each row are different, and the length of the connecting portion of the differential signal terminal closer to a bottom portion of each row is shorter, such that the lengths of the connecting portions of the two differential signal terminals in each pair of differential signal terminals have a large difference, thus affecting the coupling between the two differential signal terminals, and further affecting the high frequency characteristics thereof. Further, to allow the connecting portion in each row to bend and extend along the vertical direction in order to be connected between the contact portion and the conductive portion, the method of cutting a plain plate or punching and bending it is generally adopted such that the connecting portion has multiple bending angles, and the connecting portion may change its extending direction at each bending angle, thus facilitating the bending and extending of the connecting portion through the bending angles. However, the bending angles hinder the current flow of the signals, and large resistance exists at each of the bending angles, such that the signal transmission loss significantly increases. Therefore, having multiple bending angles on the differential signal terminals may affect the high frequency characteristics thereof, which is not conducive to the high frequency signal transmission of the differential signal terminals.

Therefore, a heretofore unaddressed need to design a novel electrical connector and an electrical connector assembly exists in the art to address the aforementioned deficiencies and inadequacies.

SUMMARY

The present invention is directed to an electrical connector and an electrical connector assembly, in which the two first signal conductors in each pair of first signal conductors have the same length, and each pair of first signal conductors bends to be arc-shaped without bending angles, thus facilitating the coupling between the two first signal conductors in each pair of first signal conductors. Meanwhile, the insulating block is arc-shaped, thus facilitating the mutual position limiting of the electrical modules in the vertical direction and the front-rear direction without easy displacement therebetween.

To achieve the foregoing objective, the present invention adopts the following technical solutions. An electrical connector includes: a plurality of electrical modules sequentially stacked along a vertical direction and fixed by at least one fixing mechanism, wherein each of the electrical modules comprises an insulating block being arc-shaped, a row of conductors fixed to the insulating block and arranged along a left-right direction perpendicular to the vertical direction, and at least one first shielding member provided to cover the insulating block, a front-rear direction is defined to be perpendicular to the vertical direction and the left-right direction, the first shielding member and each of the conductors bend and extend downward from a top thereof and backward from a front thereof to be arc-shaped, each of the conductors comprises a first contact portion, a first conductive portion and a connecting portion connected to the first contact portion and the first conductive portion, and the first contact portions of the row of conductors located on the same one of the electrical modules are located on a same horizontal plane; wherein the row of conductors comprises a plurality of first grounding conductors and a plurality of pairs of first signal conductors arranged alternately along the left-right direction, and the two first signal conductors in a same pair of the pairs of first signal conductors have a same length; and wherein the first shielding member has a first main body portion overlapping with a projection of at least one pair of the pairs of first signal conductors in the vertical direction, and at least one first grounding portion extending from the first main body portion to be electrically connected to at least one of the first grounding conductors.

In certain embodiments, the fixing mechanism is provided on two adjacent insulating blocks of any two adjacent ones of the electrical modules stacked vertically to fix the two adjacent insulating blocks, the fixing mechanism comprises a protruding portion and a positioning slot correspondingly fixing the protruding portion, and each of the two adjacent insulating blocks is selectively provided with the protruding portion and/or the positioning slot to match with the positioning slot and/or the protruding portion of the other of the two adjacent insulating blocks.

In certain embodiments, of the two adjacent insulating blocks, a lower arc surface of the insulating block located at an upper side thereof is downward protrudingly provided with the protruding portion, the protruding portion comprises a first stepping portion and a protruding leg sequentially downward from a top thereof, the first stepping portion abuts an upper arc surface of the insulating block located at a lower side thereof, a width of the protruding leg along the front-rear direction is less than a width of the first stepping portion, the upper arc surface of the insulating block located at the lower side thereof is downward concavely provided with the positioning slot, and the protruding leg is inserted downward in and fixed to the positioning slot of the insulating block located at the lower side thereof.

In certain embodiments, an end of the upper arc surface of the insulating block located at the lower side thereof away from the positioning slot is protruding provided with a second stepping portion, and the second stepping portion abuts the lower arc surface of the adjacent insulating block located at the upper side thereof.

In certain embodiments, the fixing mechanism comprises two fixing plates and at least two protruding blocks provided on each of the insulating blocks of the electrical modules, the two fixing plates are respectively located at a left side and a right side of the electrical modules, and the two protruding blocks are respectively provided to protrude outward from a left side and a right side of each of the insulating blocks;

inner surfaces of the two fixing plates are provided to be opposite to each other along the left-right direction, at least one fixing slot is formed by being outward concavely provided on each of the inner surfaces of the two fixing plates, and each of the at least one fixing slot correspondingly accommodates one of the protruding blocks.

In certain embodiments, the first main body portion is provided with at least one elongated rib protruding toward at least one of the first grounding conductors, and the elongated rib is in contact with the connecting portion of a corresponding one of the first grounding conductors.

In certain embodiments, the first shielding member is fixed to an upper arc surface of the insulating block, the upper arc surface is downward concavely provided with at least one elongated slot portion to expose the connecting portion of at least one of the first grounding conductors, and the at least one elongated slot portion matches and accommodates a corresponding one of the at least one elongated rib.

In certain embodiments, the connecting portions of the conductors of a same one of the electrical modules are located on a same arc surface, the first conductive portions of the same one of the electrical modules are located on a same plane, the insulating block of at least one of the electrical modules has a penetrating slot provided to run vertically therethrough, and at least one portion of each of the connecting portions of each pair of the pairs of first signal conductors is exposed in the penetrating slot.

In certain embodiments, the electrical connector has an insulating mating shell, a front end of the insulating mating shell has a mating cavity to accommodate each of the first contact portion, a rear end of the insulating mating shell has two extending walls connected to the mating cavity and respectively provided at a left side and a right side of the insulating block, and an insertion slot is outward concavely provided on an inner surface of each of the two extending walls;

the electrical connector has an insulating rear shell located behind the mating cavity, the insulating rear shell has a reserved space reserved for the electrical modules, at least one insertion bar is provided to protrude outward from each of a left side wall and a right side wall of the insulating rear shell, the insertion bar is inserted into a corresponding one of the insertion slots of the two extending walls such that the insulating rear shell is detachably assembled forward to the insulating mating shell from a rear thereof.

In certain embodiments, each of the extending walls has a plurality of insertion slots, at least one insertion block is provided to protrude outward from each of a left side wall and a right side wall of each of the insulating blocks of the electrical modules, each of the at least one insertion block is inserted into a corresponding one of the insertion slots, and each of the at least one insertion block is stopped by a front end surface or a lower end surface of the corresponding one of the insertion slots.

In certain embodiments, in each of the electrical modules, the first shielding member is provided to cover an upper arc surface of the insulating block, two position limiting portions are provided to protrude upward from a left end and a right end of the upper arc surface of the insulating block, and a recess portion is formed between the two position limiting portions to accommodate the first shielding member.

In certain embodiments, the first main body portion is provided to cover an upper arc surface of the insulating block, the first grounding portion bends and extends toward an upper surface of a corresponding one of the first grounding conductors from a front end of the first main body portion, the front end of the first main body portion extends forward to form at least one first mating portion to be in contact with a mating connector, and the first grounding portion and the first mating portion are provided to be adjacent to each other in the left-right direction;

at least one second grounding portion is formed by bending and extending toward at least one of the first grounding conductors from a lower end of the first main body portion, and the second grounding portion is electrically connected to a corresponding one of the first grounding conductors.

In certain embodiments, in each of the electrical modules, the first main body portion is provided to cover the upper arc surface of the insulating block, at least one clamping protruding portion is provided to protrude upward from the upper arc surface of the insulating block, and the first main body portion is provided with at least one clamping through hole to accommodate the corresponding at least one clamping protruding portion;

the clamping protruding portion is located right above the corresponding one of the first grounding conductors, the clamping through hole directly faces the corresponding one of the first grounding conductors in the vertical direction, the first mating portion is located right above a corresponding pair of the pairs of the first signal conductors, and the clamping through hole is provided to be staggered with the first mating portion in the left-right direction.

In certain embodiments, in a same one of the electrical modules, the first signal conductors and the first grounding conductors are injection-molded once together with the insulating block to form an integral structure, and dielectric coefficients of the insulating block at different locations are identical.

To achieve the foregoing objective, the present invention further adopts the following technical solutions. An electrical connector assembly includes: an electrical connector, comprising a plurality of electrical modules sequentially stacked along a vertical direction and fixed by at least one fixing mechanism, wherein each of the electrical modules comprises an insulating block being arc-shaped, a row of conductors fixed to the insulating block and arranged along a left-right direction perpendicular to the vertical direction, and at least one first shielding member provided to cover the insulating block, a front-rear direction is defined to be perpendicular to the vertical direction and the left-right direction, the first shielding member and each of the conductors bend and extend downward from a top thereof and backward from a front thereof to be arc-shaped, each of the conductors comprises a first contact portion, a first conductive portion and a connecting portion connected to the first contact portion and the first conductive portion, and the first contact portions of the row of conductors located on the same one of the electrical modules are located on a same horizontal plane; wherein the row of conductors comprises a plurality of first grounding conductors and a plurality of pairs of first signal conductors arranged alternately along the left-right direction, and the two first signal conductors in a same pair of the pairs of first signal conductors have a same length; and wherein the first shielding member is electrically connected to at least one of the first grounding conductors, the first shielding member has a first main body portion located above at least one pair of the pairs of first signal conductors, and at least one first mating portion extends forward from the first main body portion; and a mating connector, configured to mate with the electrical connector, wherein the mating connector has an insulating body, a plurality of second grounding conductors and a plurality of pairs of second signal conductors arranged alternately on the insulating body, and at least one second shielding member fixed to the insulating body; each of the second grounding conductors and each of the second signal conductors in each pair of the pairs of second signal conductors has at least one second contact portion to be in contact with a corresponding one of the first contact portion, and a second conductive portion to be in contact with a circuit board and located in front of the second contact portion; the second shielding member is electrically connected to at least one of the second grounding conductors, the second shielding member has a second main body portion shielding above the pairs of second signal conductors, and a second mating portion extends backward from the second main body portion; wherein when the mating connector is inserted into the electrical connector and electrically connected to the pairs of first signal conductors, the second mating portion is electrically connected to the first mating portion, the second contact portion of each of the second signal conductors is electrically connected to the first contact portion of a corresponding one of the first signal conductors, and the second contact portion of each of the second grounding conductors is electrically connected to the first contact portion of a corresponding one of the first grounding conductors.

Compared with the related art, the electrical connector and the electrical connector assembly according to certain embodiments of the present invention have the following beneficial effects. The two first signal conductors in each pair of first signal conductors have the same length, thus facilitating the coupling between the two first signal conductors in each pair of first signal conductors, and each pair of first signal conductors bends to be arc-shaped without bending angles, such that the extending direction of each pair of first signal conductors gradually transitions and bends, and the extending direction of each pair of first signal conductors does not suddenly turn and bend, thereby allowing the resistance of each pair of first signal conductors to be relatively small and shortening the signal transmission path thereof, thus facilitating high frequency signal transmission. The electrical modules are sequentially stacked along the vertical direction, and the insulating block is arc-shaped, thus facilitating the mutual position limiting of the electrical modules in the vertical direction and the front-rear direction without easy displacement therebetween. Further, the first grounding conductors and the pairs of first signal conductors are arranged alternately along the left-right direction, and the first main body portion of the first shielding member overlaps with the projection of the pairs of first signal conductors in the vertical direction, such that the first shielding member may perform signal shielding to the pairs of first signal conductors in the vertical direction, and the first grounding conductors may perform signal shielding to the pairs of first signal conductors in the left-right direction, thus multi-directionally reducing the interference caused by the interfering signals to each pair of the first signal conductors. The first contact portions of the row of conductors located on the same one of the electrical modules are located on a same horizontal plane, which is convenient for mating with the mating connector, thus ensuring stable mating effect, and allowing the row of conductors to be formed by punching together, and in injection-molding the insulating block, the injection mold uniformly fixes the first contact portions of the row of conductors. Further, in the electrical connector assembly, the first mating portion of the first shielding member and the second mating portion of the second shielding member are electrically connected, thus increasing the grounding paths of the first shielding member, preventing the first shielding member from being in unstable contact with the first grounding conductors and affecting the shielding effect of the first shielding member, and facilitating the effective shielding of the first shielding member to the pairs of first signal conductors, which is conducive to the high frequency signal transmission of the pairs of first signal conductors.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
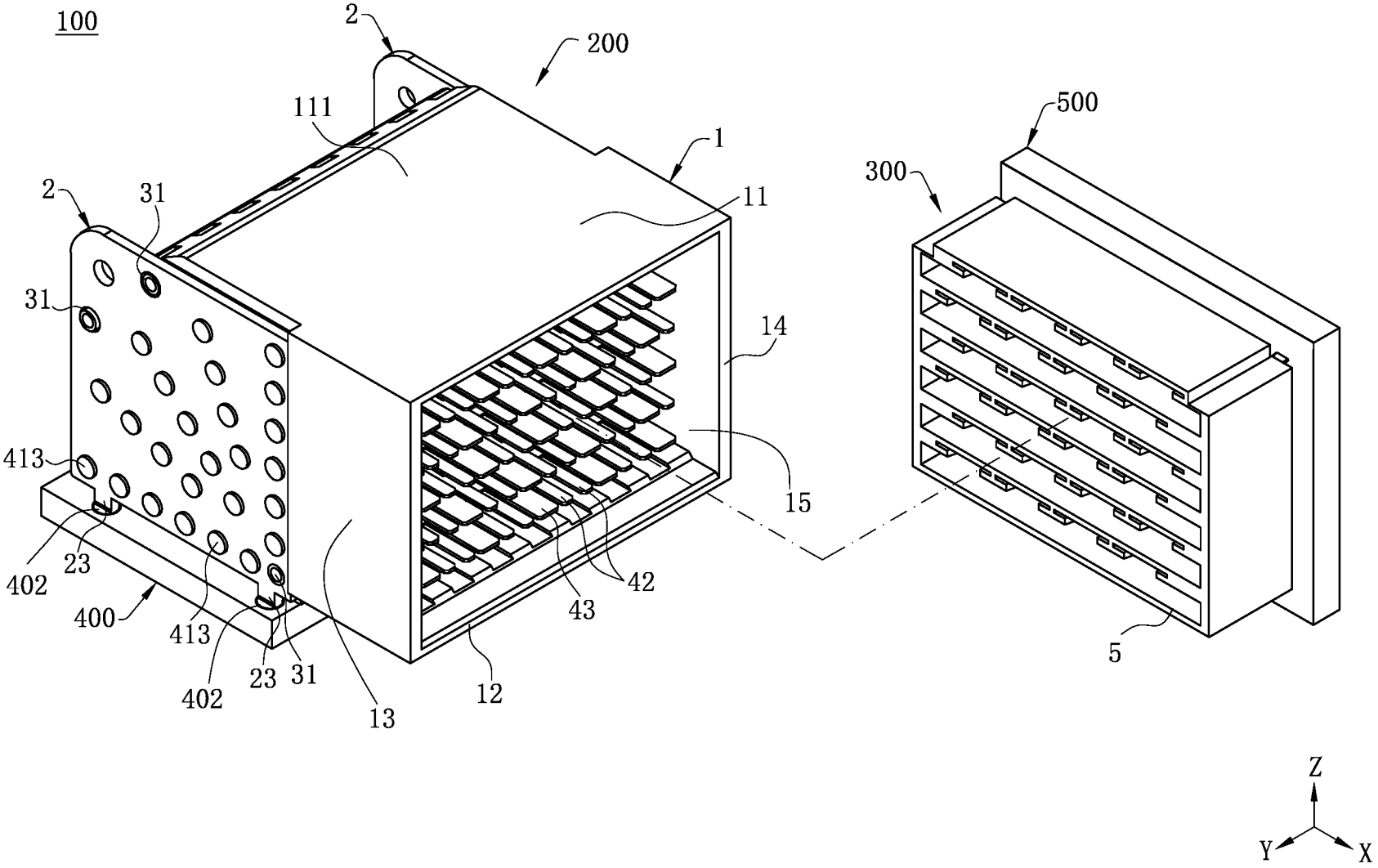
FIG. 1 is a perspective schematic view of an electrical connector and a mating connector of an electrical connector assembly not being mated according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-18. In accordance with the purposes of this invention, as embodied and broadly described herein, this invention, in one aspect, relates to an electrical connector and an electrical connector assembly.

For convenience to understand the technical solutions of the present invention, in the three-dimensional coordinates of the accompanying drawings, the X-axis is defined as a front-rear direction, the Y-axis is defined as a left-right direction, and the Z axis is defined as a vertical direction. Each two of the X-axis, the Y-axis and the Z-axis are perpendicular to each other.

Figure 2:
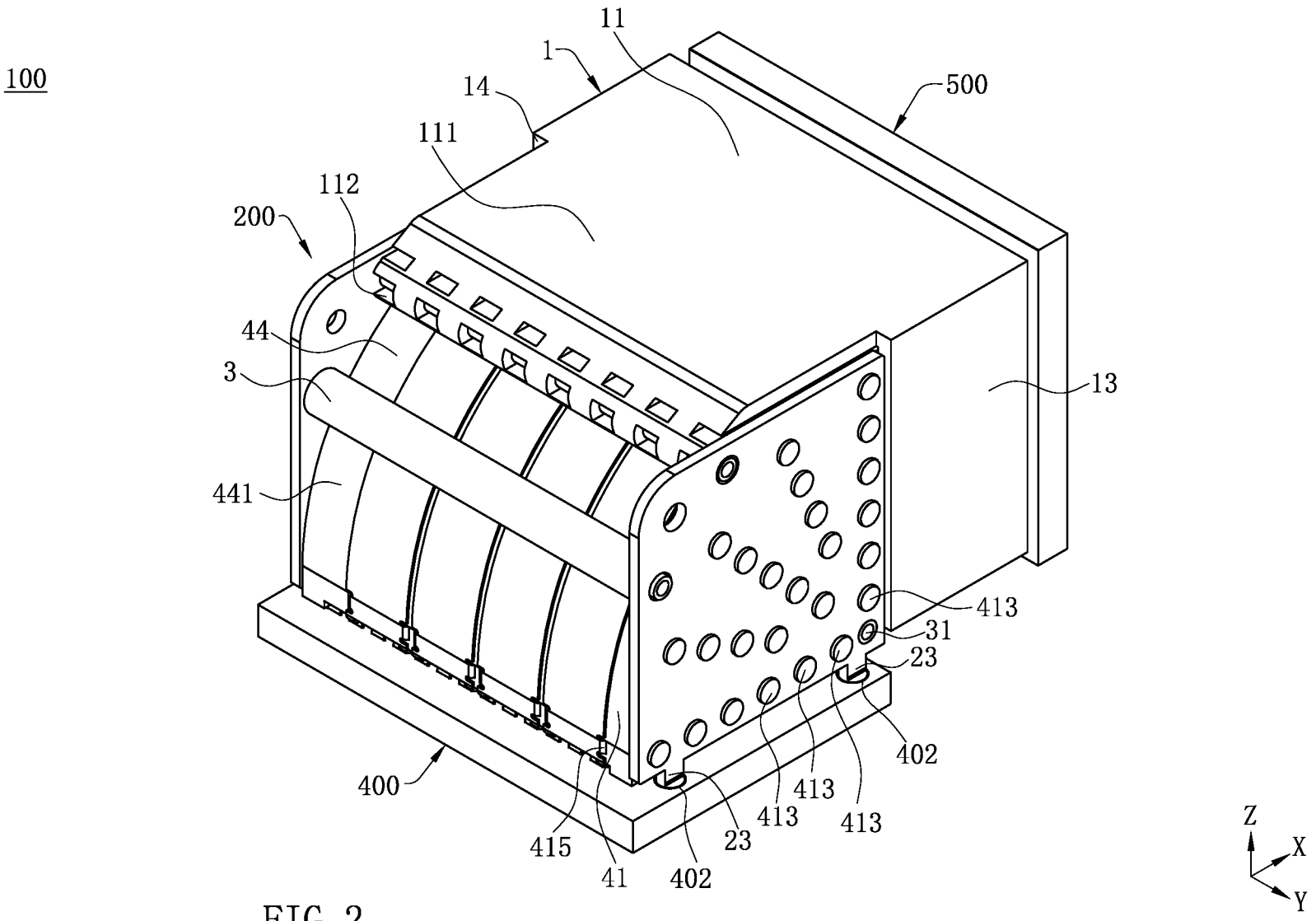
FIG. 2 is a perspective schematic view of an electrical connector and a mating connector of an electrical connector assembly after completion of mating according to the first embodiment of the present invention.
Figure 3:
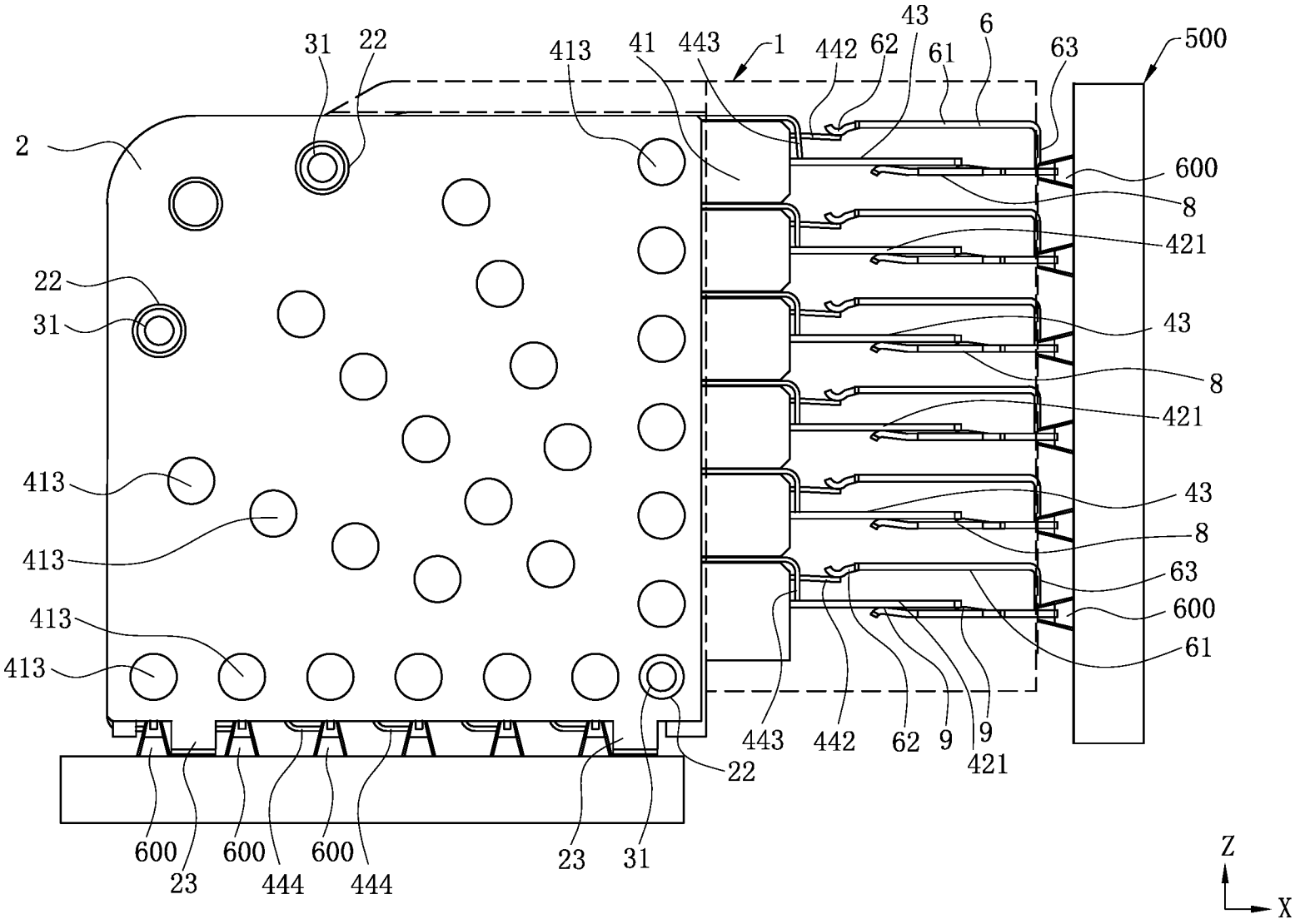
FIG. 3 is a side view of the electrical connector assembly as shown in FIG. 2 in which the insulating mating shell and the insulating body are hidden.

FIG. 1 to FIG. 3 show an electrical connector assembly 100 according to a first embodiment of the present invention, which includes an electrical connector 200 and a mating connector 300 mated with the electrical connector 200. A vertical direction Z is defined. A lower end of the electrical connector 200 is connected to a first circuit board 400. A front-rear direction X is defined along a mating direction of the electrical connector 200 and the mating connector 300. A front end of the electrical connector 200 has an insulating mating shell 1, and a front end of the insulating mating shell 1 has a mating cavity 15 for a rear end of the mating connector 300 to be inserted backward into the mating cavity 15. A front end of the mating connector 300 is electrically connected to a second circuit board 500.

Figure 4:
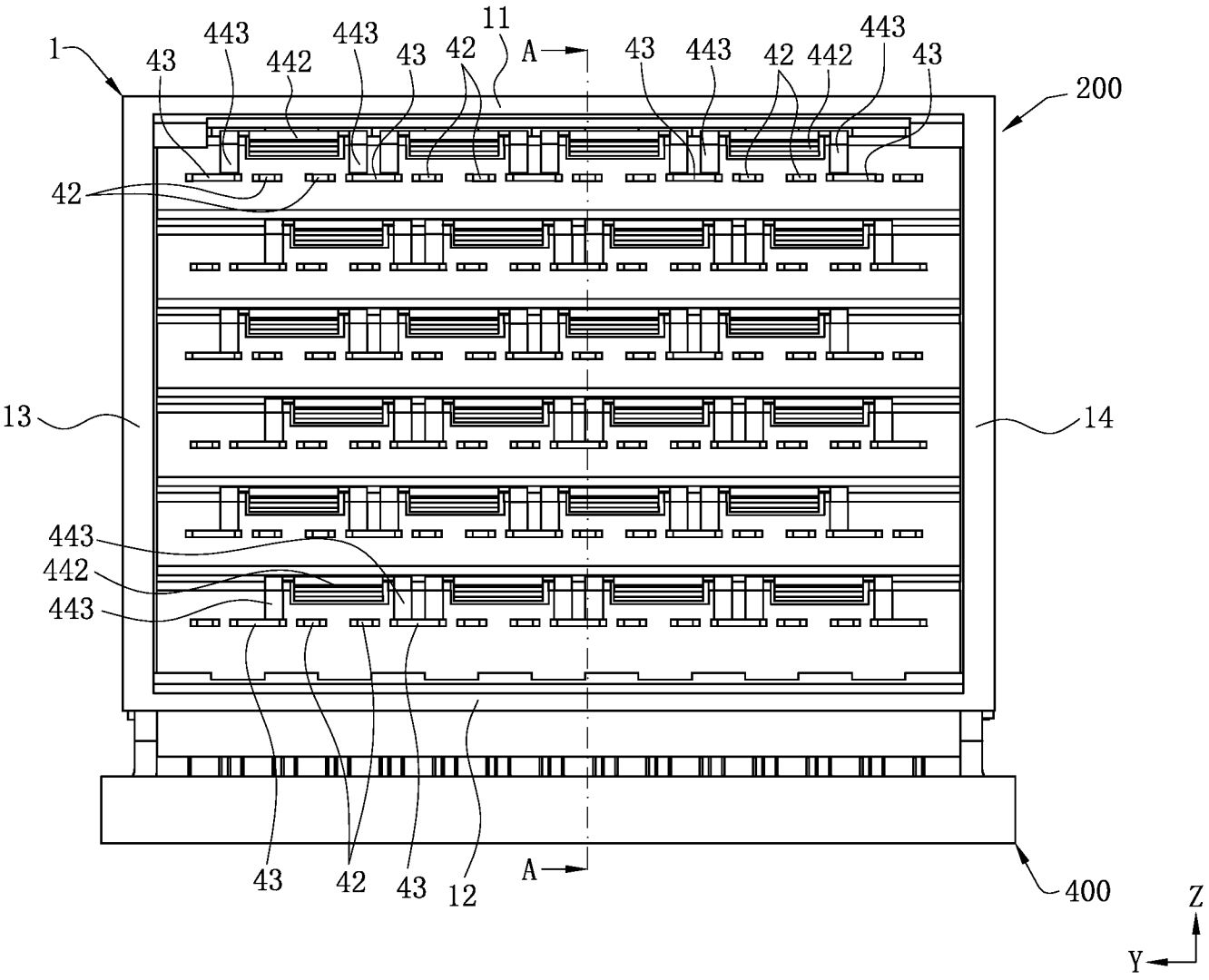
FIG. 4 is a plain view of the electrical connector according to the first embodiment of the present invention.
Figure 5:
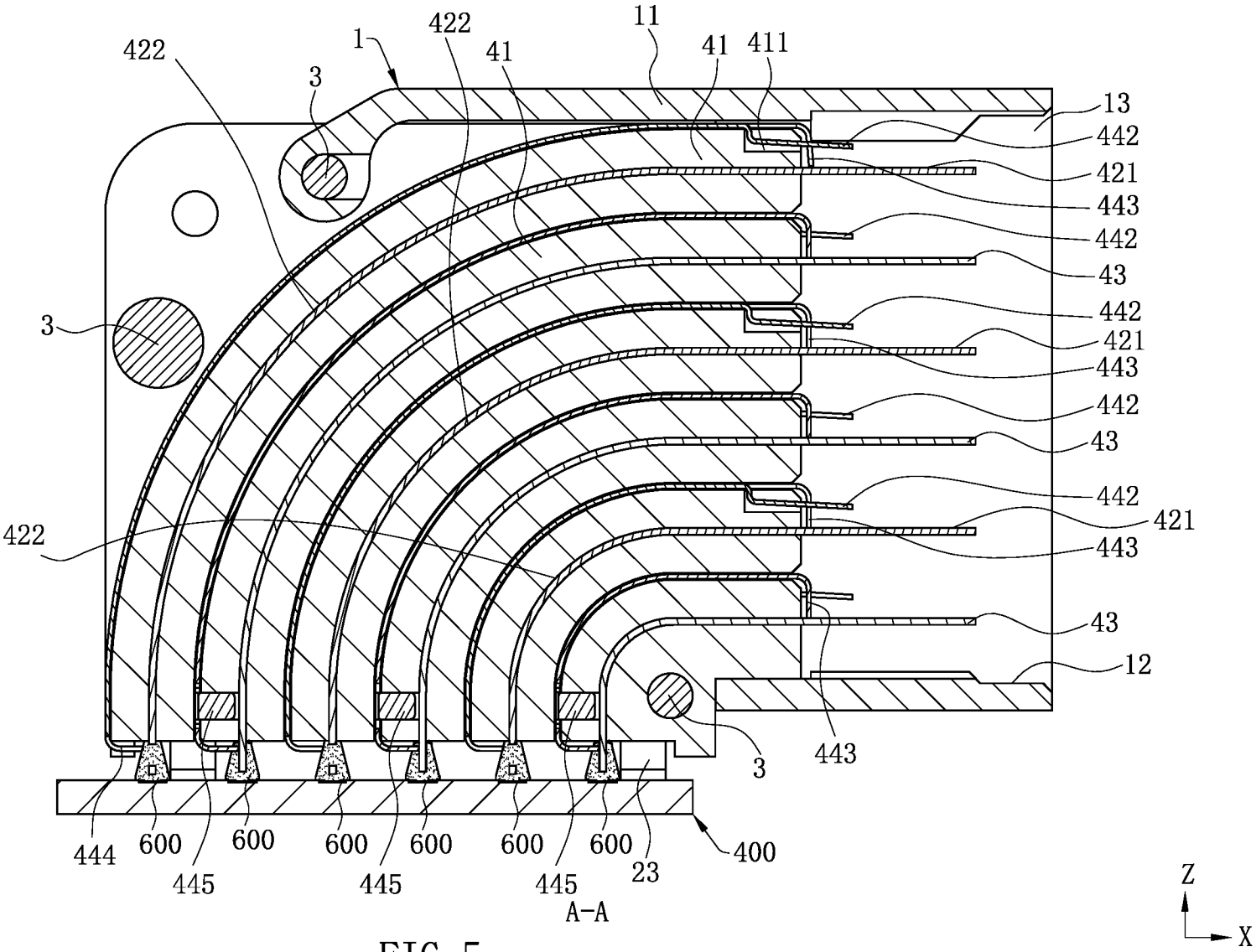
FIG. 5 is a sectional view of FIG. 4 along the A-A sectional line.

FIG. 4 and FIG. 5 show an electrical connector 200 according to the first embodiment of the present invention. The electrical connector 200 includes an insulating mating shell 1 located at the front end of the electrical connector 200 and a plurality of electrical modules 4. The front end of the insulating mating shell 1 has the mating cavity 15. The mating cavity 15 is surrounded by four side walls, in which an upper side wall 11 and a lower side wall 12 extend horizontally along the left-right direction Y, and a left side wall 13 and a right side wall 14 extend vertically along the vertical direction Z. The electrical modules 4 are sequentially stacked along the vertical direction Z and fixed by a fixing mechanism (not shown, same below), and a front end of each electrical module 4 is accommodated in the mating cavity 15.

Figure 10:
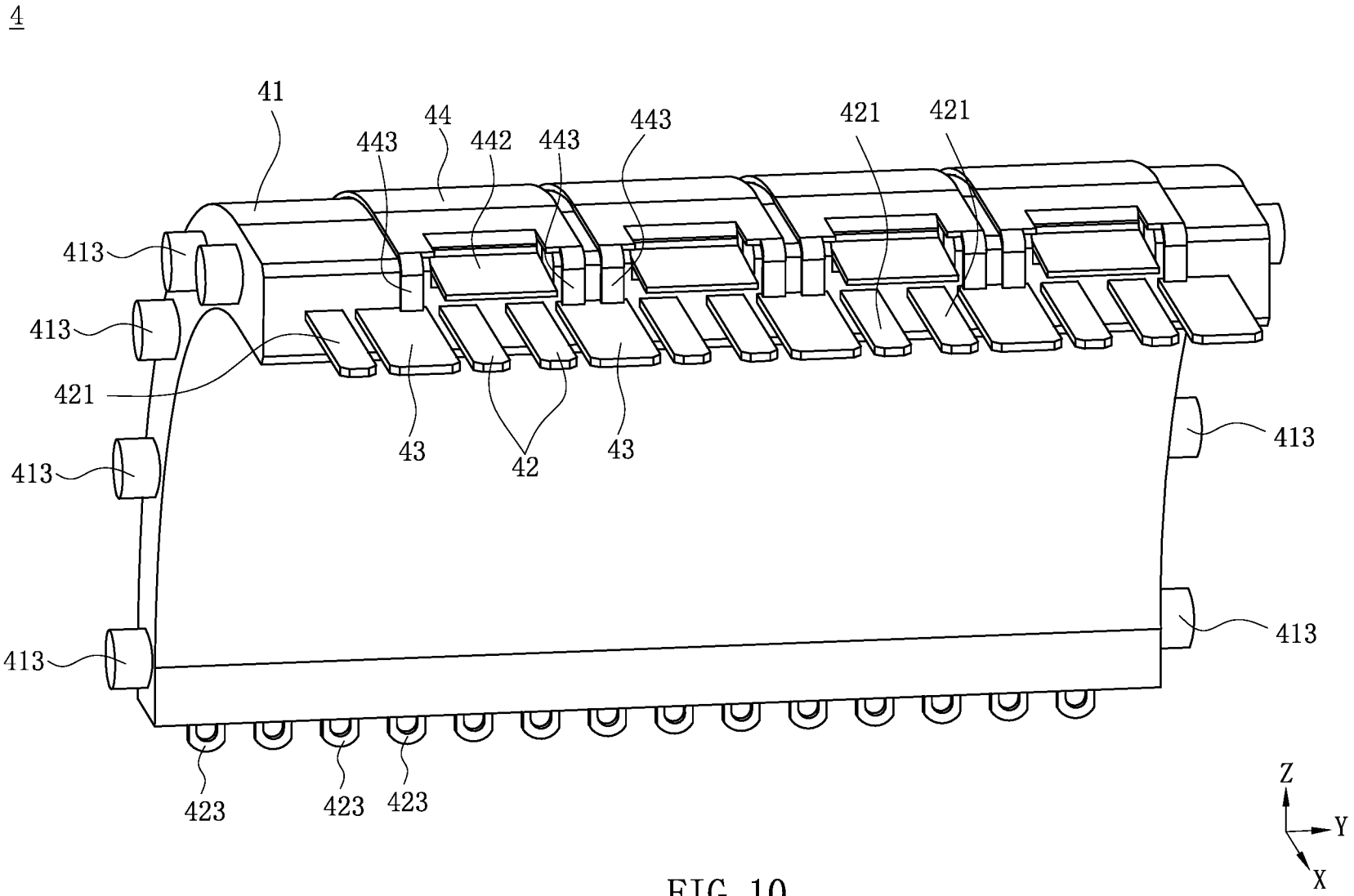
FIG. 10 is a perspective view of the electrical module from another viewing angle according to the first embodiment of the present invention.

Referring to FIG. 1, FIG. 3 and FIG. 10, the mating connector 300 provided in the first embodiment of the present invention includes an insulating body 5, a plurality of second shielding member 6 fixed to the insulating body 5, and a plurality of second grounding conductors 8 and a plurality of pairs of second signal conductors 7 alternately arranged and fixed to the insulating body 5. Each pair of the second signal conductors 7 includes two second signal conductors, and each of a left side and a right side of each pair of the second signal conductors 7 is provided with one of the second grounding conductors 8. The second shielding members 6 and the pairs of second signal conductors 7 one-to-one correspond to each other, and each second shielding member 6 is provided above the corresponding pair of the second signal conductors 7. Each second shielding member 6 has a second main body portion 61 shielding above the corresponding pair of the second signal conductors 7, and a second mating portion 62 extends backward from the second main body portion 62 to mate with the first shielding member 44 of the electrical connector 200. When the mating of the electrical connector 200 and the mating connector 300 is completed, each pair of the first signal conductors 42 is one-to-one correspondingly in contact with each pair of the second signal conductors 7, each first grounding conductor 43 is one-to-one correspondingly in contact with each second grounding conductor 8, and each first shielding member 44 is one-to-one correspondingly in contact with each second shielding member 6.

Figure 6:
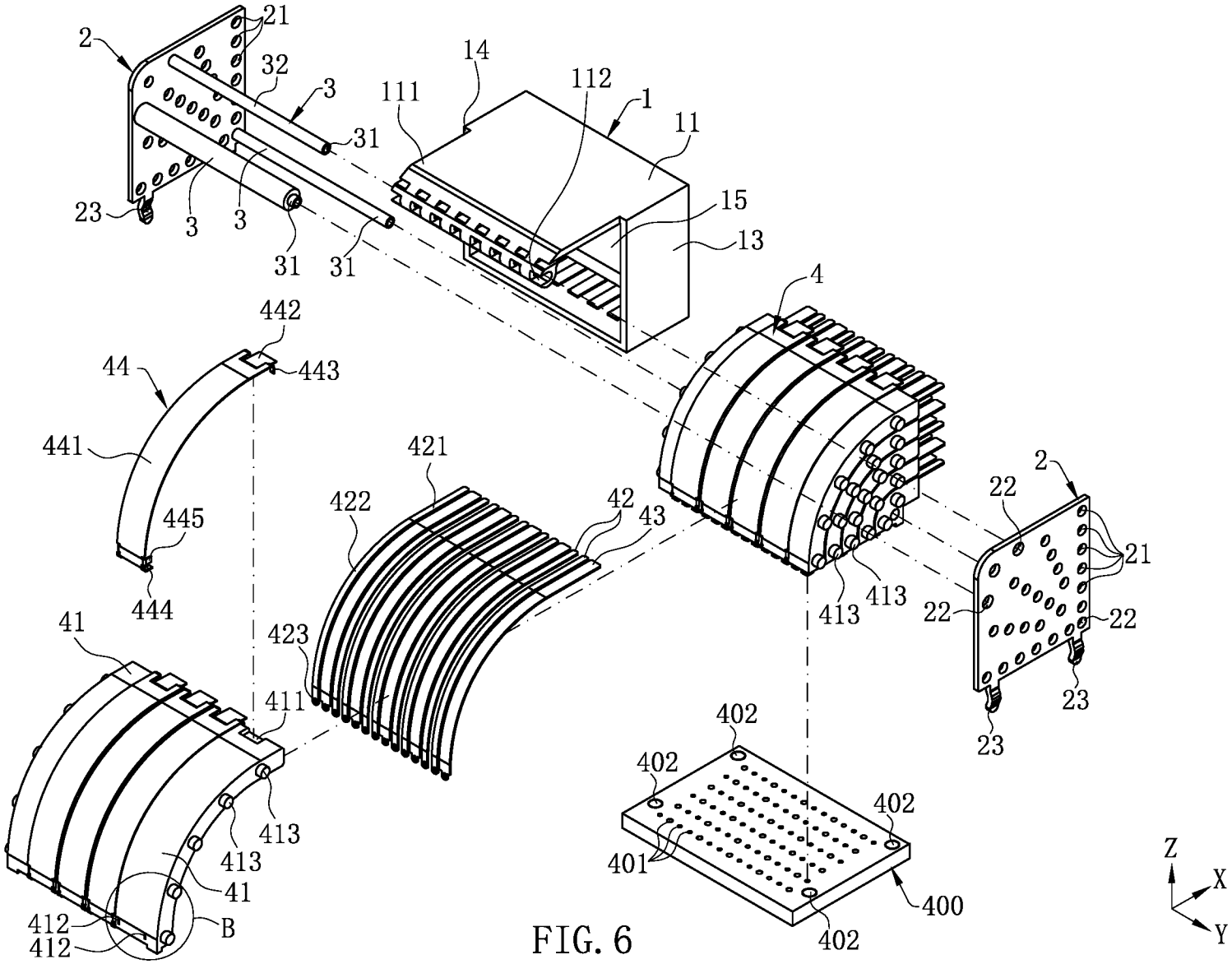
FIG. 6 is a perspective exploded view of the electrical connector according to the first embodiment of the present invention.

Referring to FIG. 4, FIG. 5 and FIG. 6, in the electrical connector 200, each electrical module 4 includes an insulating block 41, a plurality of first grounding conductors 43 and a plurality of pairs of first signal conductors 42 alternately arranged on the insulating block 41 along the left-right direction Y, and a plurality of first shielding members 44 fixed to the insulating block 41 and wrapped by a top surface of the insulating block 41. The first shielding members 44 are used to mate with the second shielding members 6 of the mating connector 300. An upper surface of each first grounding conductor 43 is at least partially exposed on the insulating block 41. Each pair of the first signal conductors 42 includes two first signal conductors, and each of a left side and a right side of each pair of the first signal conductors 42 is provided with one of the first grounding conductors 43. Each first shielding member 44, each first grounding conductor 43 and each first signal conductor of each pair of the first signal conductors 42 bend and extend downward from a top thereof and backward from a front thereof to be arc-shaped. The first shielding members 44 and the pairs of first signal conductors 42 are one-to-one correspondingly provided, and each first shielding member 44 is located above the corresponding pair of the first signal conductors 42. A width of each first grounding conductor 43 along the left-right direction Y is greater than a width of each first signal conductor, thus facilitating transmission of electricity, providing a large gap between two adjacent pairs of the first signal conductors 42 in the left-right direction, and reducing the signal crosstalk between the two adjacent pairs of the first signal conductors 42.

Each first signal conductor in each pair of the first signal conductors 42 and each first grounding conductor 43 have a first contact portion 421 to be in contact with the mating connector 300, a first conductive portion 423 located behind the first contact portion 421 to be electrically connected to the first circuit board 400, and a connecting portion 422 connecting the first contact portion 421 and the first conductive portion 423. The first contact portion 421 of each first grounding conductor 43 is located at a front section of the first grounding conductor 43. A row of the first contact portions 421 located on a same one of the electrical modules 4 are located on a same horizontal plane, which is convenient for mating with the mating connector 300, thus ensuring stable mating effect, and allowing the row of the first grounding conductors 43 and the pairs of first signal conductors 42 to be formed by punching together, and in injection-molding the insulating block 41, the injection mold uniformly fixes the first contact portions 421 in the row.

The insulating block 41 is arc-shaped, and is provided to bend backward from the front thereof and downward from the top thereof. Thus, a top surface of the insulating block 41 forms an upper arc surface (not shown, same below), and a surface provided opposite to the top surface forms a lower arc surface (not shown, same below). The first contact portion 421 of each first signal conductor protrudes forward out of a front end surface of the insulating block 41, the first contact portion 421 of each first grounding conductor 43 protrudes forward out of the front end surface of the insulating block 41, the first conductive portion 423 of each first signal conductor protrudes downward out of a lower end surface of the insulating block 41, and the first conductive portion 423 of each first grounding conductor 43 protrudes downward out of the lower end surface of the insulating block 41. The first contact portion 421 of each first grounding conductor 43 is provided at a front section of the first grounding conductor 43, and the first conductive portion 423 of each first grounding conductor 43 is provided at a tail section of the first grounding conductor 43. The connecting method between each first conductive portion 423 and the first circuit board 400 may be provided according to actual situation. For example, each first conductive portion 423 may be soldered with the first conducting portion 401 of the first circuit board 400 by a solder 600 to facilitate the electrical conductive connection between each first conductive portion 423 and the first circuit board 400. In other embodiments, each first conductive portion 423 may be inserted into a metalized through hole (not shown) of the first circuit board 400 to facilitate the electrical conductive connection between each first conductive portion 423 and the first circuit board 400, and is thus not hereinafter limited. The electrical modules 4 are not limited to be stacked along the vertical direction Z, and in other embodiments, it is possible that the electrical modules 4 form multiple columns and are sequentially stacked along the left-right direction Y. However, compared to the horizontal insulating blocks 41 being sequentially stacked in the vertical direction Z or the vertical insulating blocks 41 being sequentially stacked in the left-right direction Y, the arc-shaped insulating blocks 41 are conducive to limit the electrical modules 4 from moving in the vertical direction Z and the left-right direction Y after the electrical modules 4 are stacked along the vertical direction Z, thus facilitating the stable structure of the electrical connector 200. Each first grounding conductor 43 and each first signal conductor of each pair of the first signal conductors 42 are arc-shaped, such that the extending direction of each pair of the first signal conductors 42 may gradually transition and bend, and the extending direction of each pair of the first signal conductors 42 does not suddenly turn and bend, thereby matching the arc-shaped insulating blocks 41 and shortening the signal transmission path, and the transmission loss of the signals is relatively small, thus facilitating the signal transmission of the electrical connector 200. Further, the two first signal conductors in a same pair of the first signal conductors 42 have the same length. Thus, in the electrical connector 200 provided by certain embodiments of the present invention, the two first signal conductors in each pair of first signal conductors 42 have the same length, and each pair of first signal conductors 42 bends to be arc-shaped without bending angles, which may shorten the signal transmission path and facilitate the coupling of the two first signal conductors in each pair of first signal conductors 42, thus facilitating high frequency signal transmission. In addition, the first shielding member 44 and the first grounding conductors 43 may perform signal shielding to the pairs of first signal conductors 42 in the vertical direction Z and the left-right direction Y, thus multi-directionally reducing the interference caused by the interfering signals to each pair of the first signal conductors 42.

Referring to FIG. 6, the first grounding conductors 43 and the pairs of first signal conductors 42 located on the same one of the electrical modules 4 are alternately arranged along the left-right direction Y to form a row of conductors. The first contact portions 421 of the row of conductors are located on a same horizontal plane, the connecting portions 422 of the row of conductors are located on a same arc surface, and the first conductive portions 423 of the row of conductors are located on a same plane. Two rows of the first contact portions 421 of two rows of conductors adjacent vertically are parallel to each other along the vertical direction Z, and two rows of the first conductive portions 423 of the two rows of conductors adjacent vertically are parallel to each other along the front-rear direction X, such that the electrical coupling effect of all locations of each pair of the first signal conductors 42 is better, which is more conducive to adjusting the impedance to achieve more preferred high frequency transmission effect. Each first grounding conductor 43 and each pair of the first signal conductors 42 bend to be arc-shaped, such that the first conductive portion 423 and the first contact portion 421 are perpendicular to each other, allowing the electrical connector 200 to be connected to the mating connector 300 and the first circuit board 400 perpendicular to the mating surface of the mating connector 300. Further, in the same one of the electrical modules 4, the pairs of first signal conductors 42 and the first grounding conductors 43 are injection-molded once together with the same insulating block 41 to form an integral structure altogether, and dielectric coefficients of the insulating block 41 at different locations are identical. Thus, the pairs of first signal conductors 42 and the first grounding conductors 43 are injection-molded once to bend to be arc-shaped, which do not need to go through second punching and bending, thus saving the production cost and enhancing the efficiency of the production manufacturing process. Meanwhile, the dielectric coefficients of the insulating block 41 at different locations are identical, which facilitates the high frequency signal transmission of the pairs of first signal conductors 42. Further, the front end surfaces of the insulating blocks 41 altogether define a vertical plane, and the lower end surfaces of the insulating blocks 41 altogether define a horizontal plane perpendicular to the vertical plane, thereby allowing the electrical connector 200 to be mated and connected with the mating connector 300 and the first circuit board 400 perpendicular to the mating connector 300. In this embodiment, a central angle limited by the arc-shaped insulating block 41 is substantially 90°.

Referring to FIG. 2, FIG. 3 and FIG. 6, the fixing mechanism includes two fixing plates 2 and at least two protruding blocks 413 provided on each of the insulating blocks 41. The two fixing plates 2 are respectively located at a left side and a right side of the electrical modules 4, and the two protruding blocks 413 are respectively provided to protrude outward from a left side and a right side of each insulating block 41. Each of the two fixing plates 2 has an inner surfaces, and the inner surfaces of the two fixing plates 2 are provided to be opposite to each other along the left-right direction. At least one fixing slot 21 is formed by being outward concavely provided on each of the inner surfaces of the two fixing plates 4, and each fixing slot 21 correspondingly accommodates one of the protruding blocks 413. Thus, the fixing of the electrical modules 4 is facilitated by matching the fixing slots 21 of the fixing plates 2 with the protruding blocks 413 of the insulating blocks 41. The two fixing plates 2 are parallel to each other. The two fixing plates 2 are respectively assembled at the left side and the right side of the electrical modules 4 and are respectively located at the left side and the right side of the rear of the mating cavity 15. Each fixing plate 2 is fixed to the first circuit board 400. The electrical connector 200 further includes three connecting members 3, and the three connecting members 3 are perpendicularly connected to the two fixing plates 2. An extending portion 111 extends backward from the upper side wall 11 of the mating cavity 15, and a tail end of the extending portion 111 forms an arc slot 112 to fix one of the connecting members 3.

Referring to FIG. 3, FIG. 4, FIG. 9 and FIG. 10, the first shielding members 44 are one-to-one correspondingly in contact with the second shielding members 6 of the mating connector 300. Each first shielding member 44 has a first main body portion 441 shielding above the corresponding pair of the first signal conductors 42. In this embodiment, each first main body portion 441 shields right above the corresponding pair of the first signal conductors 42. At least two first grounding portions 443 bend and extend from the first main body portion 441 toward the first grounding conductors 43. Specifically, each first grounding portion 443 is in contact with an upper surface of the corresponding first grounding conductor 43, and each first grounding portion 443 is adjacent to the first contact portion 421 of the corresponding first grounding conductor 43. A first mating portion 442 extends forward from the first main body portion 441 to be located between two first grounding portions 443, and the first mating portion 442 and the first grounding portions 443 are provided to be adjacent to each other in the left-right direction. Two second grounding portions 444 extend from a lower end of the first main body portion 441 toward the two adjacent first grounding conductors 43 to be respectively in contact with the tail ends of the two adjacent first grounding conductors 43. Specifically, each second grounding portion 444 is in contact with the upper surface of the corresponding first grounding conductor 43, and each second grounding portion 444 is adjacent to the first conductive portion 423 of the corresponding first grounding conductor 43. The second grounding portions 444 are located behind the first grounding portions 443. The first grounding portions 443 are front grounding portions, and the first mating portion 442 is a flat plate shaped mating portion, and the second grounding portions 444 are rear grounding portions.

When the mating connector 300 is inserted into the electrical connector 200 and is electrically connected to the pairs of first signal conductors 42, the second mating portion 62 downward abuts the upper surface of the first mating portion 442. Thus, the first mating portion 442 and the two first grounding portions 443 are all formed by extending from the front end of the first main body portion 441, and the first mating portion 442 is located between the two adjacent first grounding portions 443, such that the first mating portion 442 is provided to be adjacent to the two first grounding portions 443, which reduces the material used for the first shielding member 44, and when the mating connector 300 is inserted into the electrical connector 200 and is electrically connected with the pairs of first signal conductors 42, a downward pressure provided by the second mating portion 62 onto the first mating portion 442 is passed to the two adjacent first grounding portions 443, such that the two first grounding portions 443 are pressured and then in stable contact with the upper surfaces of the two adjacent first grounding conductors 43, thus facilitating the stable contact between the first shielding member 44 and the first grounding conductors 43. Further, the first shielding member 44 according to the embodiments of the present invention has more first grounding portions 443 to be in contact with the first grounding conductors 43, thus enhancing the stability of the electrical conductive connection between the first shielding member 44 and the first grounding conductors 43. Meanwhile, the first shielding member 44 and the second shielding member 6 are in contact, thus increasing the grounding paths of the first shielding member 44, preventing the first shielding member 44 from being in unstable contact with the first grounding conductors 43 and affecting the shielding effect of the first shielding member 44, and facilitating the effective shielding of the first shielding member 44 to the pairs of first signal conductors 42, which is conducive to the high frequency signal transmission of the pairs of first signal conductors 42. It should be noted that, in other embodiments, the first shielding member 44 is not necessarily fixed to the upper arc surface (i.e., the top surface) of the insulating block 41, and the first shielding member 44 may be fixed to a lower arc surface of the insulating block 41. That is, the first main body portion 441 overlaps with a projection of a corresponding pair of the first signal conductors 42 in the vertical direction Z, which allows the first main body portion 441 to perform signal shielding to the corresponding pair of the first signal conductors 42 in the vertical direction Z. Further, in the electrical modules 4 of the electrical connector 200 according to the embodiments of the present invention, except for the bottommost electrical module, each of the other electrical modules 4 has at least one first shielding member 44 located thereabove and at least one first shielding member 44 located therebelow. Thus, there are first shielding members 44 at an upper side and a lower side of each electrical module 4 to perform signal shielding for the pairs of first signal conductors 42 in each electrical module 4 at the top and bottom thereof, and the high frequency characteristics of the electrical connector 200 is much better.

Referring to FIG. 3, FIG. 5, FIG. 8 and FIG. 10, the first mating portion 442 is formed by bending downward from the front end of the first main body portion 441 and then extending obliquely forward. A front end of the first mating portion 442 is provided obliquely (i.e., in an "oblique provision") along the vertical direction Z toward a direction away from the second mating portion 62, and the first mating portion 442 extends obliquely forward and downward to guide the second shielding member 6 to smoothly mate with the first mating portion 442. In this embodiment, the first mating portion 442 is a straight plate structure, and referring to a base line L extending forward, the "oblique provision" refers to the first mating portion 442 extending obliquely downward along a straight line. An included angle between an oblique extending direction of the first mating portion 442 and a forward extending direction of the base line L is defined as an oblique angle θ of the first mating portion 442, and the oblique angle is between 0° and 90°. In certain embodiments, the oblique angle can be 3°~45°. A certain tolerance is allowed to exist between the relative positions between the first mating portion 442 and the second mating portion 62, which may prevent the first mating portion 442 and the mating portion 62 from colliding with each other in the insertion process between the electrical connector 200 and the mating connector 300 and affecting the smooth mating of the first mating portion 442 and the second mating portion 62, and by the first mating portion 442 being obliquely provided, the second mating portion 62 may be guided to smoothly mate with the first mating portion 442. Further, each first grounding portion 443 extends forward from the front end of the first main body portion 441 and extends vertically downward, and the first mating portion 442 extends forward from the front end of the first main body portion 441 and its top surface is higher than a lowest point of each first grounding portion 443. Before the mating connector 300 is inserted into the electrical connector 200, a lower end of each first grounding portion 443 is in contact with the upper surface of the corresponding first grounding conductor 43. When the lower end of each first grounding portion 443 is formed with a lower end surface and not a contact point, the lower end surface of each first grounding portion 443 is in contact with the upper surface of the corresponding first grounding conductor 43. Thus, the lower end or the lower end surface of each first grounding portion 443 is in contact with the upper surface of the corresponding first grounding conductor 43, and the first grounding portions 443 provide certain supporting effects for the first shielding member 44. Further, the top surface of the first mating portion 442 is higher than the lowest point of each first grounding portion 443, such that the first mating portion 442 does not block the front end of the corresponding pair of first signal conductors 42 or is not contact with the corresponding pair of first signal conductors 42 due to being too low, and the first mating portion 442 does not impede the mating between the corresponding pair of first signal conductors 42 and the corresponding pair of second signal conductors 7. In other embodiments, each first grounding portion 443 is not limited to extend forward from the front end of the first main body portion 441 and extend vertically downward, and it is possible to form each first grounding portion 443 by extending from a left side edge or a right side edge of the first main body portion 441 in the left-right direction Y and then extending vertically downward, which is not hereinafter limited. Further, each of the two adjacent first shielding members 44 has one of the first grounding portions 443 collectively abutting the same one of the first grounding conductors 43. That is, the first grounding conductor 43 located between the two adjacent pairs of the first signal conductors 42 is simultaneously in contact with the first grounding portions 443 of the two first shielding members 44 adjacent in the left-right direction. Thus, the first shielding members 44 and the first grounding conductors 43 may be connected in series to facilitate overall conductively connecting and grounding, thus enhancing the high frequency characteristics of the electrical connector 200.

Referring to FIG. 4 and FIG. 10, the size of the first main body portion 441 along the left-right direction Y is defined as a width, and the width of the first main body portion 441 is greater than a distance between two opposite outer side surfaces of the corresponding pair of the first signal conductors 42, thus increasing the area of the first main body portion 441, such that each first main body portion 441 has a larger area to shield above the corresponding pair of the first signal conductors 42, improving the shielding effect to the pairs of the first signal conductors 42, and allowing the two first grounding portions 443 to be in contact with the corresponding first grounding conductors 43 after extending forward and perpendicularly downward from the front end of the first main body portion 441.

Figure 8:
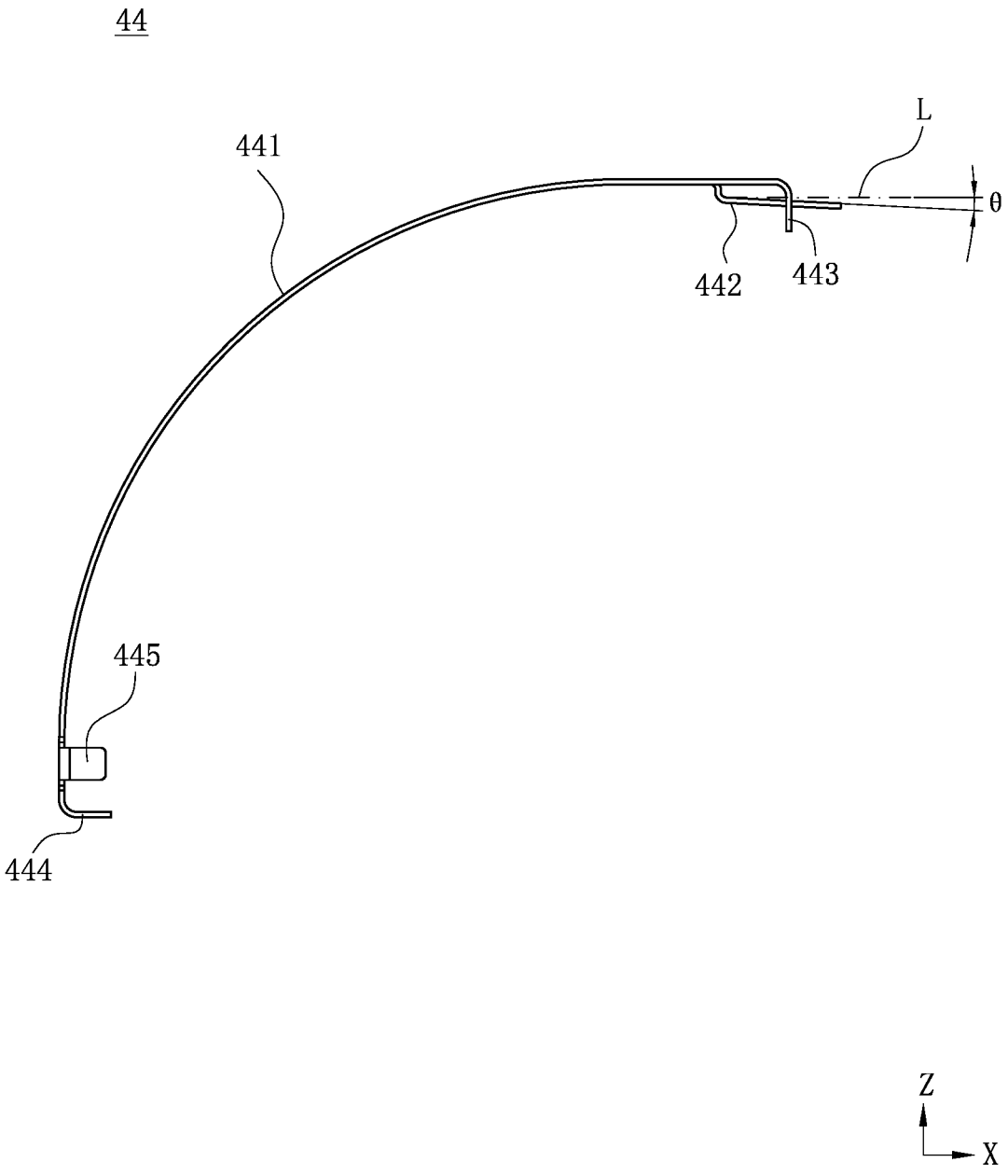
FIG. 8 is a side view of a first shielding member of the electrical connector according to the first embodiment of the present invention.
Figure 9:
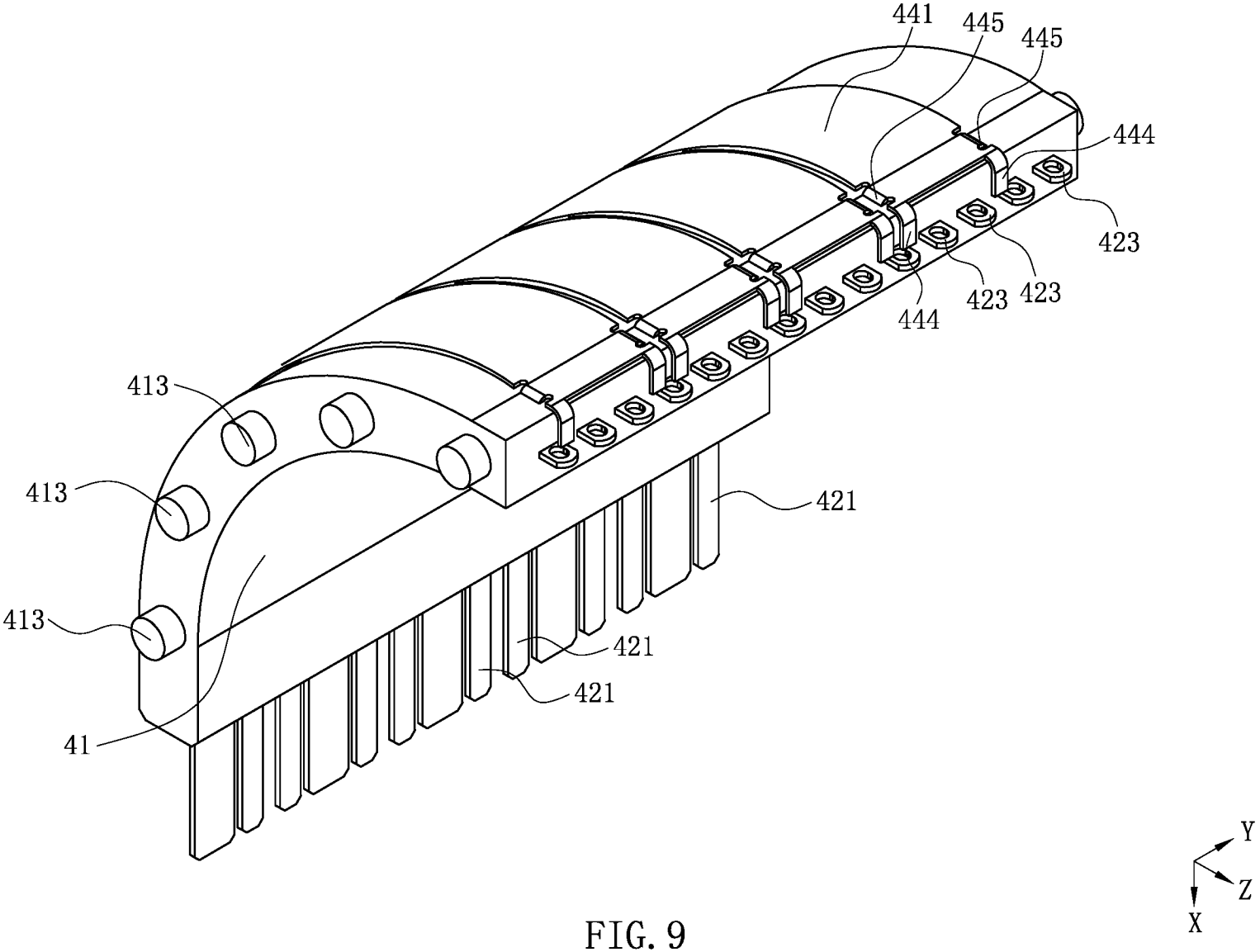
FIG. 9 is a perspective view of an electrical module according to the first embodiment of the present invention.

Referring to FIG. 8, FIG. 9 and FIG. 10, each first grounding portion 443 protrudes forward out of the front end surface of the insulating block 41 and bends and extends toward the front section of the corresponding first grounding conductor 43, and each second grounding portion 444 protrudes downward out of the lower end surface of the insulating block 41 and bends and extends toward the tail end of the corresponding first grounding conductor 43 to be in contact with the tail end of the corresponding first grounding conductor 43. Since each first grounding portion 443 and each second grounding portion 444 of the first shielding member 44 respectively protrude out of the front end surface and the lower end surface of the insulating block 41, and bend and extend toward the corresponding first grounding conductor 43 to be in contact with the corresponding first grounding conductor 43, the first grounding portions 443 may be stopped backward by the front end surface of the insulating block 41, and the second grounding portions 444 may be stopped upward by the lower end surface of the insulating block 42. The first grounding portions 443 and the second grounding portions 444 may perform position limiting functions to the first shielding member 44, thus reducing the position displacement of the first shielding member 44. In addition, the front section of each first grounding conductor 43 protrudes forward out of the front end surface of the insulating block 41, and the tail end of each first grounding conductor 43 protrudes downward out of the lower end surface of the insulating block 41. Each first grounding portion 443 is in contact with the front section of the corresponding first grounding conductor 43, and each second grounding portion 444 is in contact with the tail end of the corresponding first grounding conductor 43, which is convenient for observing the contact situation, and allows the first shielding member 44 to be in contact with different areas of the first grounding conductor 43. Even though a relative displacement is generated between the first shielding member 44 and the front section or the tail end of the corresponding first grounding conductor 43, such that the first grounding portion 443 or the second grounding portion 444 is not in contact with the corresponding first grounding conductor 43, the second grounding portion 444 or the first grounding portion 443 may correspondingly maintain in contact with the corresponding first grounding conductor 43 to allow the first shielding member 44 to be continuously grounded. Further, the first contact portion 421 and the first conductive portion 423 of each first signal conductor in each pair of the first signal conductors 42 respectively transmit signals with the mating connector 300 and the first circuit board 400, and are thus more easily subject to signal interference. In certain embodiments of the present invention, the first contact portion 421 is located closer to the first grounding portion 443 relative to the connecting portion 422, and the first conductive portion 423 is located closer to the second grounding portion 444 relative to the connecting portion 422, thereby enhancing the shielding effects to the first contact portion 421 and the first conductive portion 423 respectively through the first grounding portion 443 and the second grounding portion 444, and improving the high frequency characteristics of the electrical connector 200.

Figure 7:
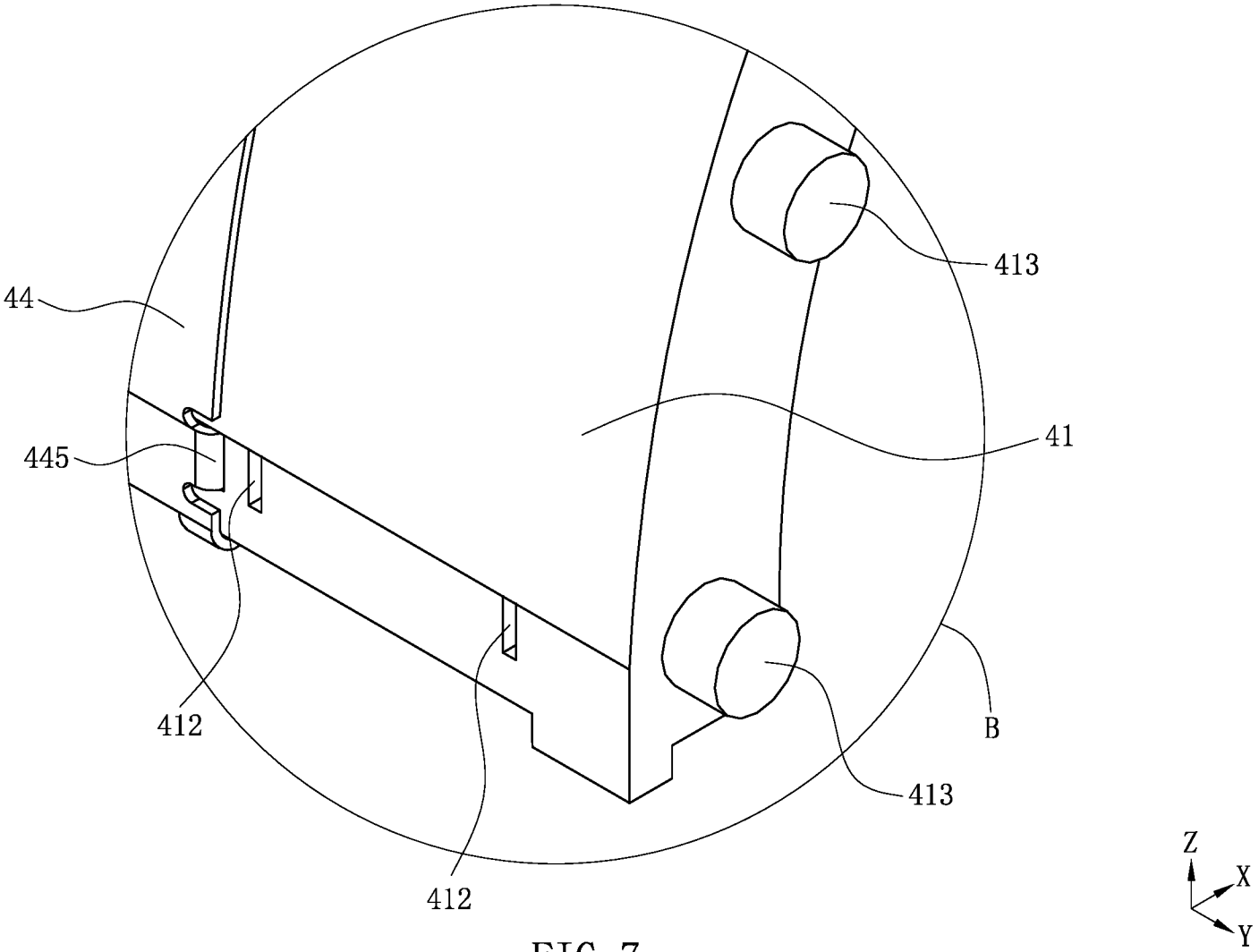
FIG. 7 is an enlarged view of a portion B as shown in FIG. 6.

Referring to FIG. 6, FIG. 7 and FIG. 8, each insulating block 41 is provided with a plurality of grooves 411, a plurality of insertion holes 412 and a plurality of protruding blocks 413. The grooves 411 are formed by being backward concavely provided on the front end surface of each insulating block 41. The insertion holes 412 are formed by being forward concavely provided on a bottom portion of each insulating block 41, and the protruding blocks 413 are provided to protrude outward from the left side and the right side of each insulating block 41. The first mating portion 442 bends and extends downward from the first main body portion 441 and then extends forward to form in a plate shape. The first mating portion 442 of each first shielding member 44 is correspondingly accommodated in one of the grooves 441, and the first mating portion 442 is backward stopped by a rear end surface of the corresponding groove 441. Thus, the positions of the first shielding members 44 may be further limited by the grooves 411, thereby preventing each first shielding member 44 from position deviating and affecting the signal shielding to the pairs of first signal conductors 42. Each of the left side edge and the right side edge of the first main body portion 441 of each first shielding member 44 bends and extends forward to form an insertion leg 445, and each insertion leg 445 is inserted into a corresponding one of the insertion holes 412, thus facilitating fixing the first shielding member 44 to the insulating block 41. In other embodiments, the quantity of the insertion leg 445 bending and extending from each of the left side edge and the right side edge of the first main body portion 441 is not limited to one, as there may be two or more than two insertion legs 445 bending and extending from each of the left side edge and the right side edge of the first main body portion 441, and the bending and extending direction of each insertion leg 445 may be specifically adjusted based on the location of the insertion leg 445 on the first main body portion 441, which is not hereinafter limited.

Referring to FIG. 4, FIG. 5 and FIG. 6, in the electrical modules 4 sequentially stacked along the vertical direction Z, the first grounding conductors 43 of the two electrical modules 4 vertically adjacent to each other are provided to be staggered. Thus, one of the first grounding conductors 43 may be present above or below each pair of the first signal conductors 42, which helps the signal shielding of the pairs of first signal conductors 42 in the vertical direction Z. Each of the left side surface and the right side surface of the insulating block 41 of each electrical module 4 is provided with a corresponding protruding block 413 protruding outward, and the fixing slots 21 are formed by being outward concavely provided on the two opposite inner surfaces of the two fixing plates 2, such that each fixing slot 21 correspondingly accommodate one of the protruding blocks 413, thereby facilitating the two fixing plates 2 being assembled respectively at the left side and right side of the electrical modules 4. Each fixing plate 2 further has two connecting legs 23 protruding out of a lower end surface of each fixing plate 2 to be inserted in corresponding grounding through holes 402 of the first circuit board 400. The two fixing plates 2 are formed by electrically conductive materials, thereby allowing the two fixing plates 2 to be grounded through the first circuit board 400, such that the two fixing plates 2 perform signal shielding at the left side and the right side of the electrical modules 4, thus reducing the interference to the electrical connector 200 caused by the environmental interfering signals.

Referring to FIG. 1, FIG. 2, FIG. 5 and FIG. 6, the three connecting members 3 are perpendicularly connected to the two fixing plates 2 provided in parallel, and each connecting member 3 extends along the left-right direction Y and is perpendicular to each fixing plate 2. Each of the two ends of each connecting member 3 has a fixing portion 31. Each fixing plate 2 has three accommodating holes 22, and each fixing portion 31 is accommodated in a corresponding one of the accommodating holes 22, thereby facilitating the connection and fixing of the connecting members 3 and the fixing plates 2. The three accommodating holes 22 of each fixing plate 2 forms three vertices of a virtual triangle, and the three connecting members 3 form three side edges of a virtual triangular prism, thus enforcing the connection stability between the three connecting members 3 and the two fixing plates 2 by the triangular locations, and enhancing the structural stability of the electrical connector 200. Each connecting member 3 is formed by electrically conductive materials, thereby allowing the two fixing plates 2 to be grounded through the connecting members 3. When one of the fixing plates 2 is in ill contact with the first circuit board 400, the other fixing plate 2 which is normally grounded is still conductively connected to the first circuit board 400 to achieve the grounding and shielding effect. Meanwhile, the electrical modules 4 are stacked to each other in assembly, and the insulating mating shell 1, the three connecting members 3 and the two fixing plates 2 are assembled and connected to fix or accommodate the electrical modules 4. Comparing to the case where an integrally formed structure is used for fixing or accommodating the electrical modules 4, the present invention is convenient for detaching and assembling the insulating mating shell 1, the three connecting members 3 and the two fixing plates 2, and for increasing or reducing the quantity of the electrical modules 4 according to actual usage and need. Further, the insulating mating shell 1 is located at the front end of the electrical connector 200, and the front end of the insulating mating shell 1 has the mating cavity 15 to accommodate the front ends of each pair of the first signal conductors 42 and the front ends of the first grounding conductors 43. An extending portion 111 extends backward from the upper side wall 11 of the mating cavity 15, a tail end of the extending portion 111 forms an arc slot 112, and the arc slot 112 extends along the left-right direction Y. Each connecting member 3 has a cylindrical portion, and the three connecting members 3 are staggered to each other in the vertical direction Z and the front-rear direction X. A first connecting member 3 is located lowermost and frontmost relative to the other two connecting members 3 and is fixed to the insulating block 41 of the lowermost electrical module 4, and the two fixing portions 31 at the two ends of the first connecting member 3 respectively protrude out of the left and right side surfaces of the insulating block 41 to be inserted into corresponding accommodating holes 22. A second connecting member 3 is located rearmost relative to the other two connecting members 3, and is located between the first connecting member 3 and a third connecting member 3 in the vertical direction Z. The third connecting member 3 is located uppermost relative to the other two connecting members 3, and is located between the first connecting member 3 and the second connecting member 3 in the front-rear direction X. The third connecting member 3 is cylindrical-shaped, and has a center portion 32 located between the two fixing portions 31 located at the two ends thereof. The center portion 32 is fixed in the arc slot 112, thereby facilitating the fixing of the insulating mating shell 1 and the third connecting member 3.

Figure 11:
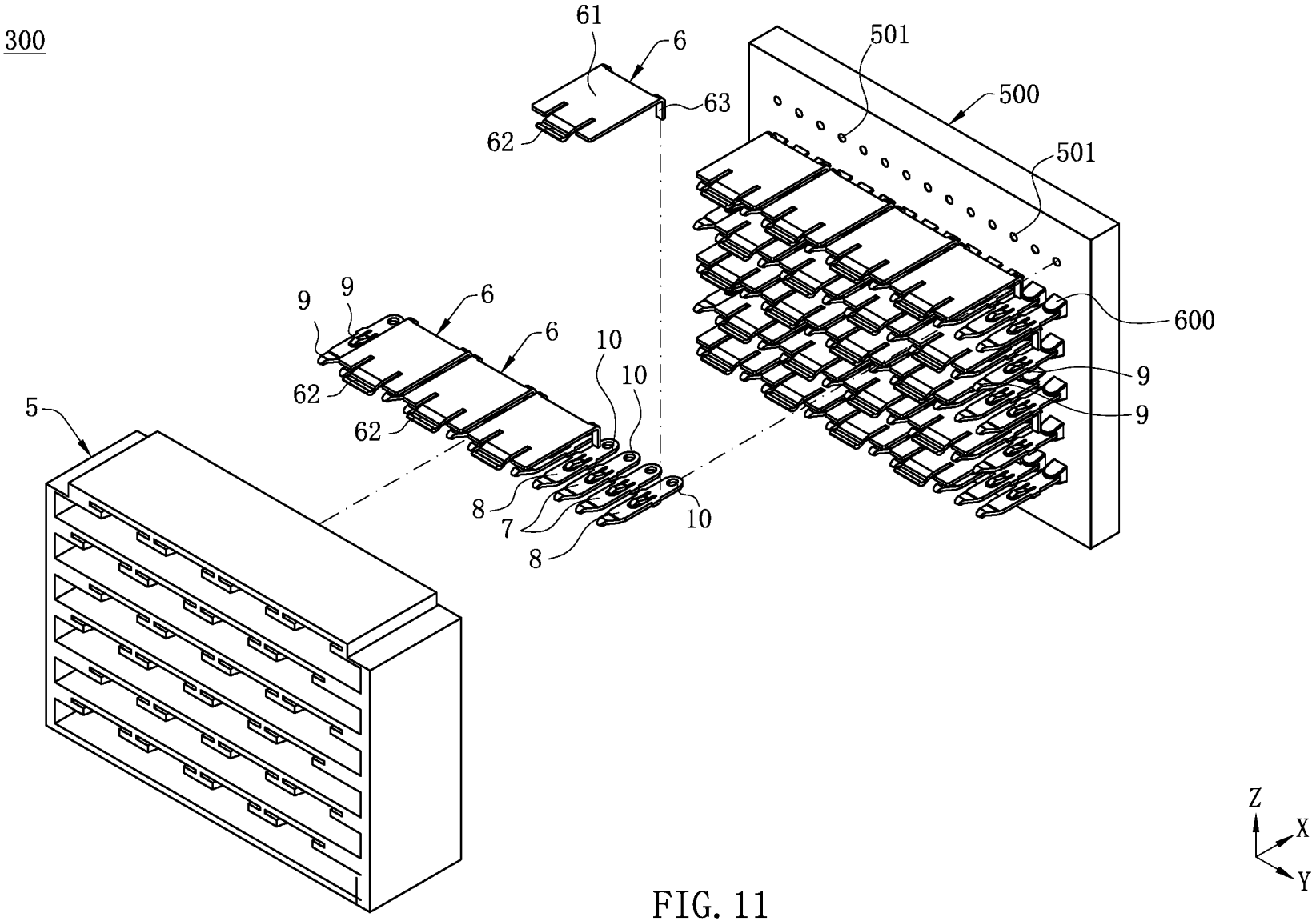
FIG. 11 is a perspective exploded view of the mating connector according to the first embodiment of the present invention.
Figure 12:
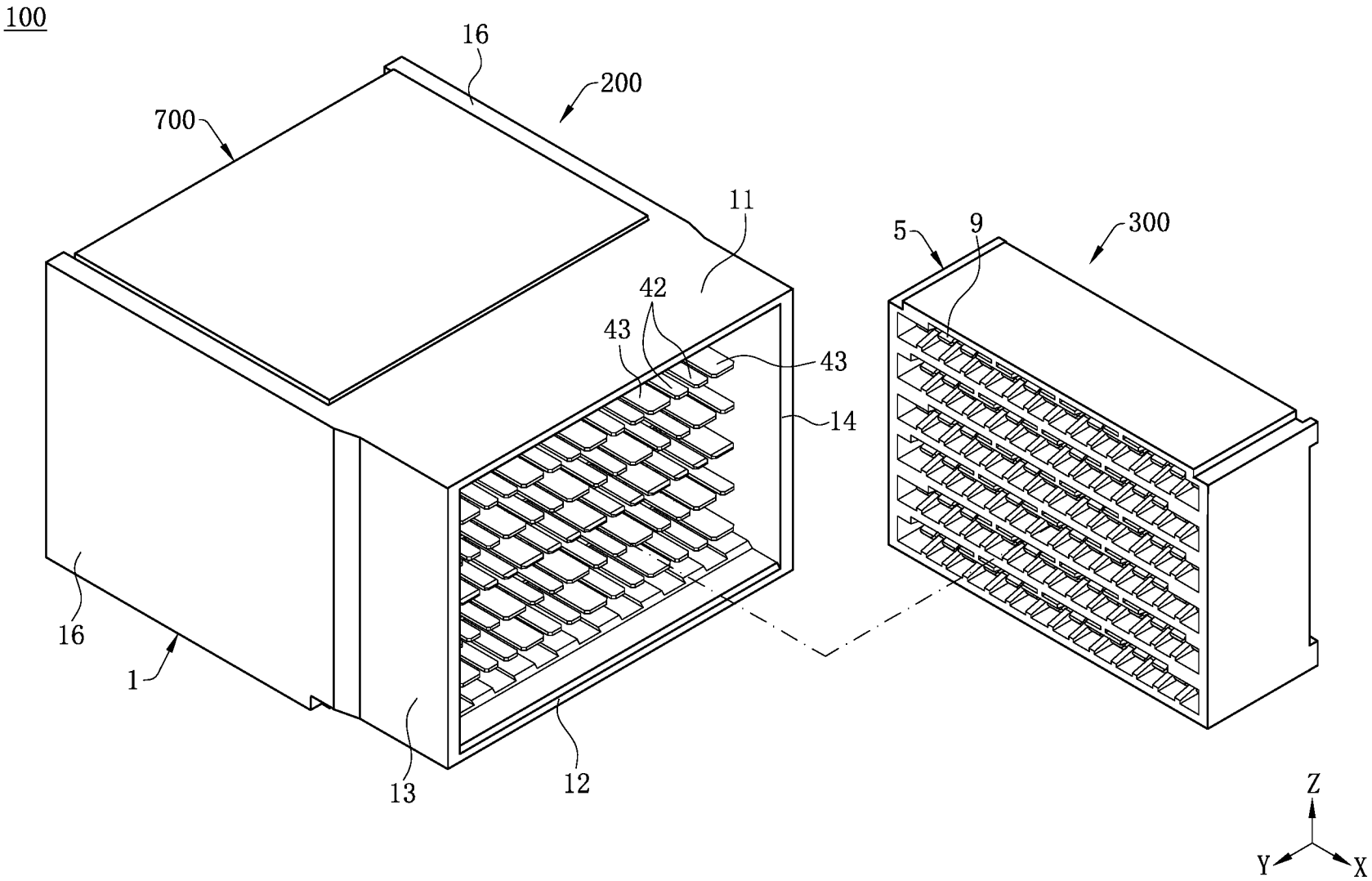
FIG. 12 is a perspective schematic view of an electrical connector and a mating connector of an electrical connector assembly not being mated according to a second embodiment of the present invention.
Figure 13:
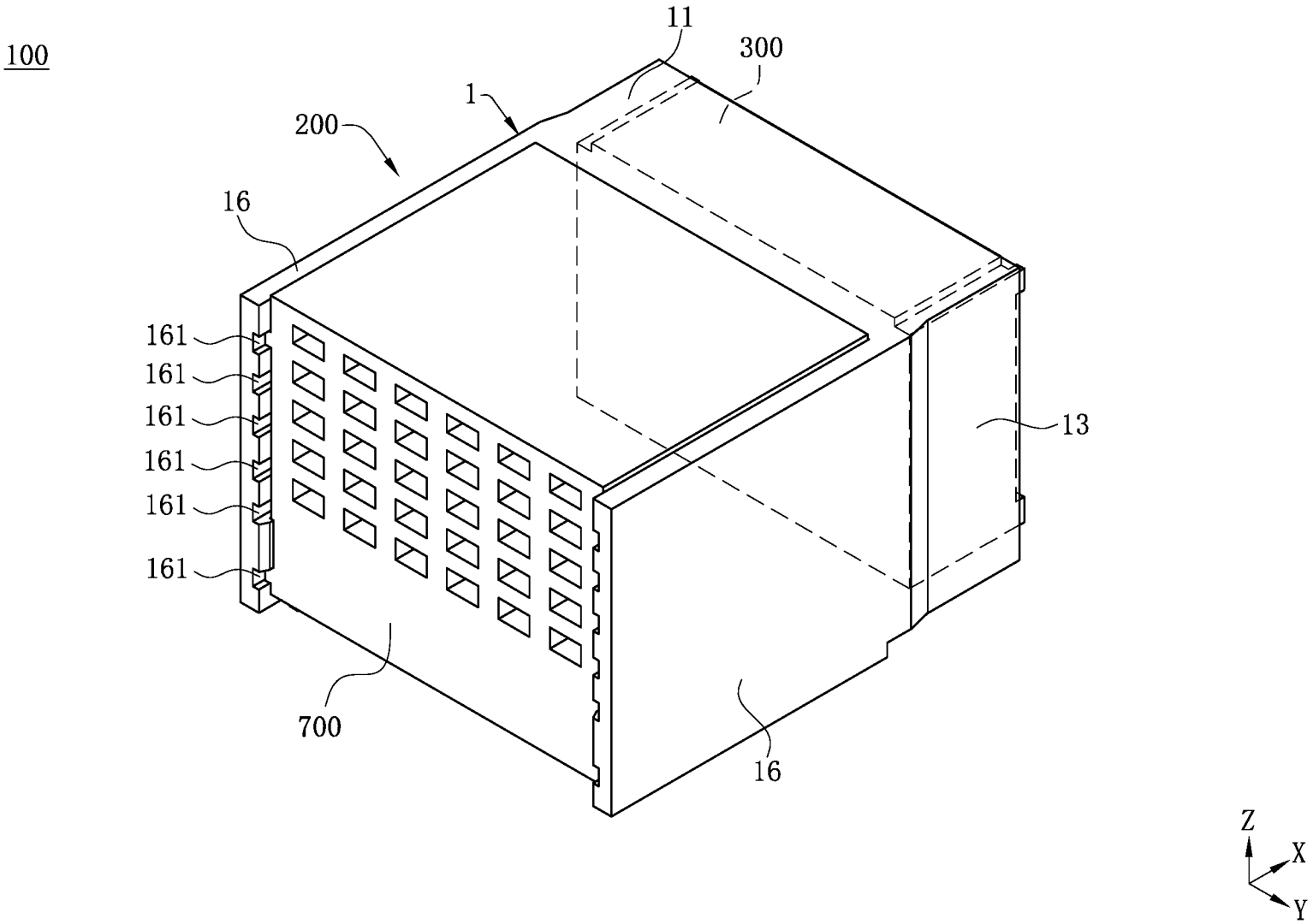
FIG. 13 is a perspective schematic view of an electrical connector and a mating connector of an electrical connector assembly after completion of mating according to the second embodiment of the present invention.

Referring to FIG. 3 and FIG. 11, in the mating connector 300, each second mating portion 62 bends and extends backward and downward from a middle portion of the rear end of the corresponding second main body portion 61 to form an elastic arm shape, in order to elastically abut downward the upper surface of the corresponding first mating portion 442. Two third grounding portions 63 bends and extends forward and downward from the front end of each second main body portion 61, and the two third grounding portions 63 are electrically connected to the two second grounding conductors 8 located at the left side and the right side of the corresponding pair of the second signal conductors 7. Thus, when the mating connector 300 is inserted into the electrical connector 200 to be electrically connected to the pairs of first signal conductors 42, the conductive grounding of the first grounding conductors 43, the first shielding member 44, the second shielding members 6 and the second grounding conductors 8 as a whole can be facilitated by the first grounding conductors 43 being in contact with the first shielding member 44, the first shielding member 44 being in contact with the second shielding member 6, and the second shielding member 6 being in contact with the second grounding conductors 8, thus improving the high frequency characteristics of the electrical connector 200. Further, each of the two adjacent second shielding members 3 in the left-right direction has one of the third grounding portions 63 mutually in contact with the same one of the second grounding conductors 8. Thus, the second shielding members 3 arranged along the left-right direction may facilitate overall conductive grounding through the second grounding conductors 8 being in mutual contact therewith, thus improving the high frequency characteristics of the electrical connector 200.

Referring to FIG. 11, each second grounding conductor 8 has two second contact portions 9 provided to bend backward and upward and respectively upward abutting the lower surfaces of the corresponding first grounding conductor 43. Each second signal conductor in each pair of the second signal conductors 7 has two second contact portions 9 provided to bend backward and upward and respectively abutting the lower surface of each first signal conductor in each pair of the first signal conductors 42, and the bending direction of the second mating portion 62 is opposite to the bending direction of each second contact portion 9. Specifically, the second mating portion 62 extends backward and bends downward to abut the upper surface of the first mating portion 442, and each second contact portion 9 extends backward and bends upward to abut the lower surface of the first contact portion 421 or the lower surface of the front section of the corresponding first grounding conductor 43. Thus, after the mating connector 300 is successfully mated with the electrical connector 200, the mating connector 300 may clamp the electrical connector 300 vertically, and the mating of the mating connector 300 and the electrical connector 200 is stable. The first contact portion 421 and the front section of each first grounding conductor 43 are all flat plate shaped, and each second contact portion 9 is elastic arm shaped bending upward, which allows each second contact portion 9 to abut the lower surface of the first contact portion 421 or the lower surface of the front section of the corresponding first grounding conductor 43. Further, each second grounding conductor 8 and each second signal conductor in each pair of the second signal conductors 7 have a second conductive portion 10 located in front of the second contact portion 9 to be electrically connected to the second circuit board 500. The connecting method of the second conductive portions 10 and the second circuit board 500 may be provided according to actual situation. For example, each second conductive portion 10 may be soldered to the second conducting portion 501 by a solder 600, thus facilitating the electrical conductive connection between the second conductive portions 10 and the second circuit board 500. In other embodiments, the second conductive portions 10 may be inserted into the metalized through holes (not shown) of the second circuit board 500, thus facilitating the electrical conductive connection between the second conductive portions 10 and the second circuit board 500, which is not limited thereto.

FIG. 12 to FIG. 16 shows an electrical connector assembly 100 provided by a second embodiment of the present invention, which includes an electrical connector 200 and a mating connector 300 mated with the electrical connector 200. The electrical connector 200 includes an insulating block 41 being arc-shaped, a row of conductors fixed to the insulating block 41, and a first shielding member 44 provided to cover the insulating block 41. The row of conductors include a plurality of first grounding conductors 43 and a plurality of pairs of first signal conductors 42 arranged alternately along the left-right direction Y. The first shielding member 44 has a first main body portion 441, and the first main body portion 441 overlaps with a projection of the pairs of first signal conductors 42 in the vertical direction Z, such that the first main body portion 441 may perform signal shielding to the pairs of first signal conductors 42 in the vertical direction Z, and the first grounding conductors 43 may perform signal shielding to the pairs of first signal conductors 42 in the left-right direction Y, thus multi-directionally reducing the interference caused by the interfering signals to each pair of the first signal conductors 42. This embodiment is different from the first embodiment in that, in the electrical connector 200, a front end of the insulating mating shell 1 has a mating cavity 15 to accommodate each first contact portion 421, and a rear end of the insulating mating shell 1 is provided with two extending walls 16 connected to the mating cavity 15. The two extending walls 16 are respectively located at a left side and a right side of the electrical modules 4. The electrical connector 200 further includes an insulating rear shell 700, and the insulating rear shell 700 is located behind the mating cavity 15. The insulating rear shell 700 is detachably assembled to the insulating mating shell 1. The insulating rear shell 700 has a reserved space 701 reserved for the electrical modules 4, and the electrical modules 4 are surrounded inside the insulating mating shell 1 and the insulating rear shell. In this embodiment, each electrical module 4 is only provided with one independent first shielding member 44 shielding the insulating block 41. The first main body portion 441 of the first shielding member 44 is provided as a whole to cover the upper arc surface of the insulating block 41, and the first shielding member 44 has a large arc surface area.

Figure 15:
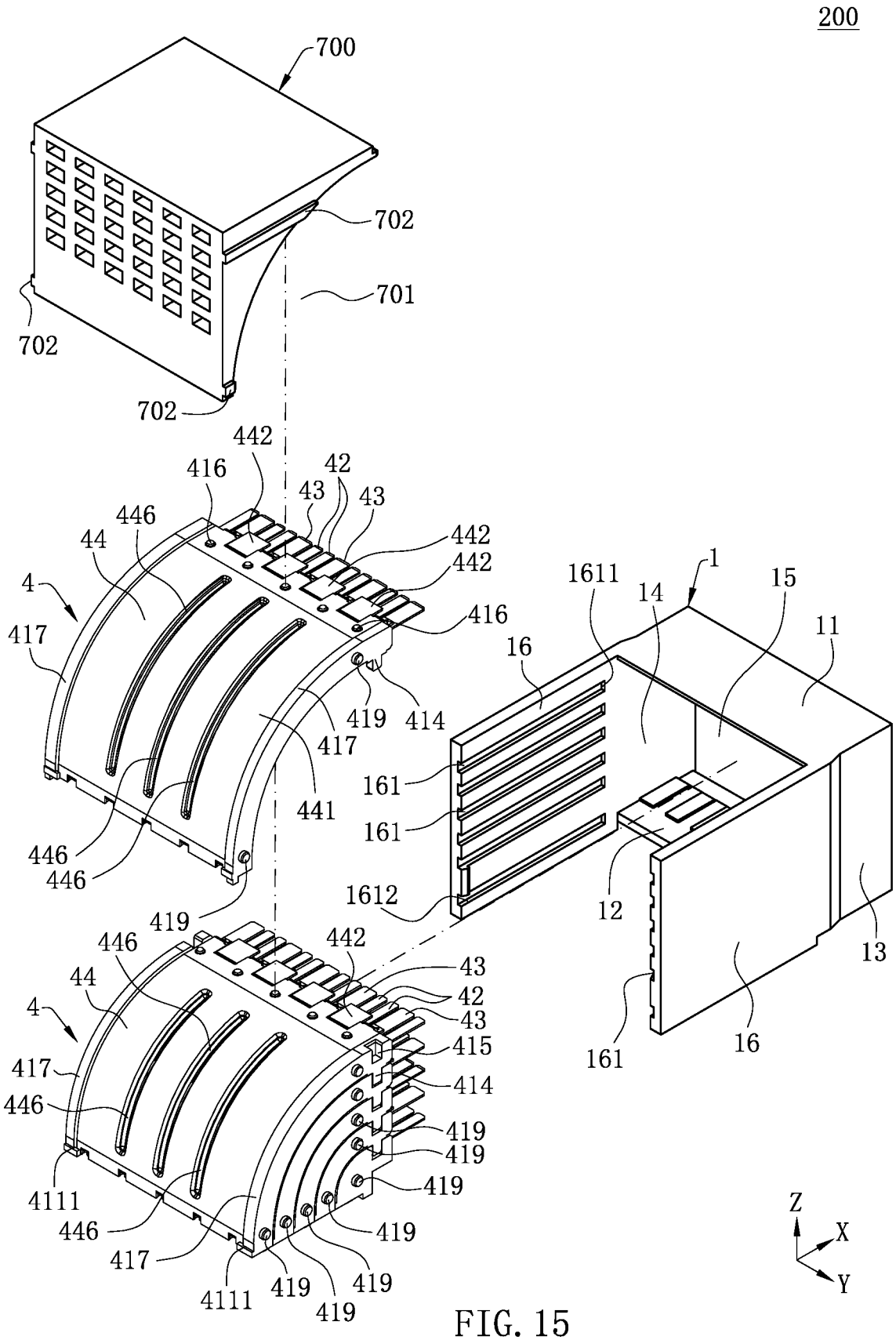
FIG. 15 is a perspective exploded view of the electrical connector according to the second embodiment of the present invention.
Figure 16:
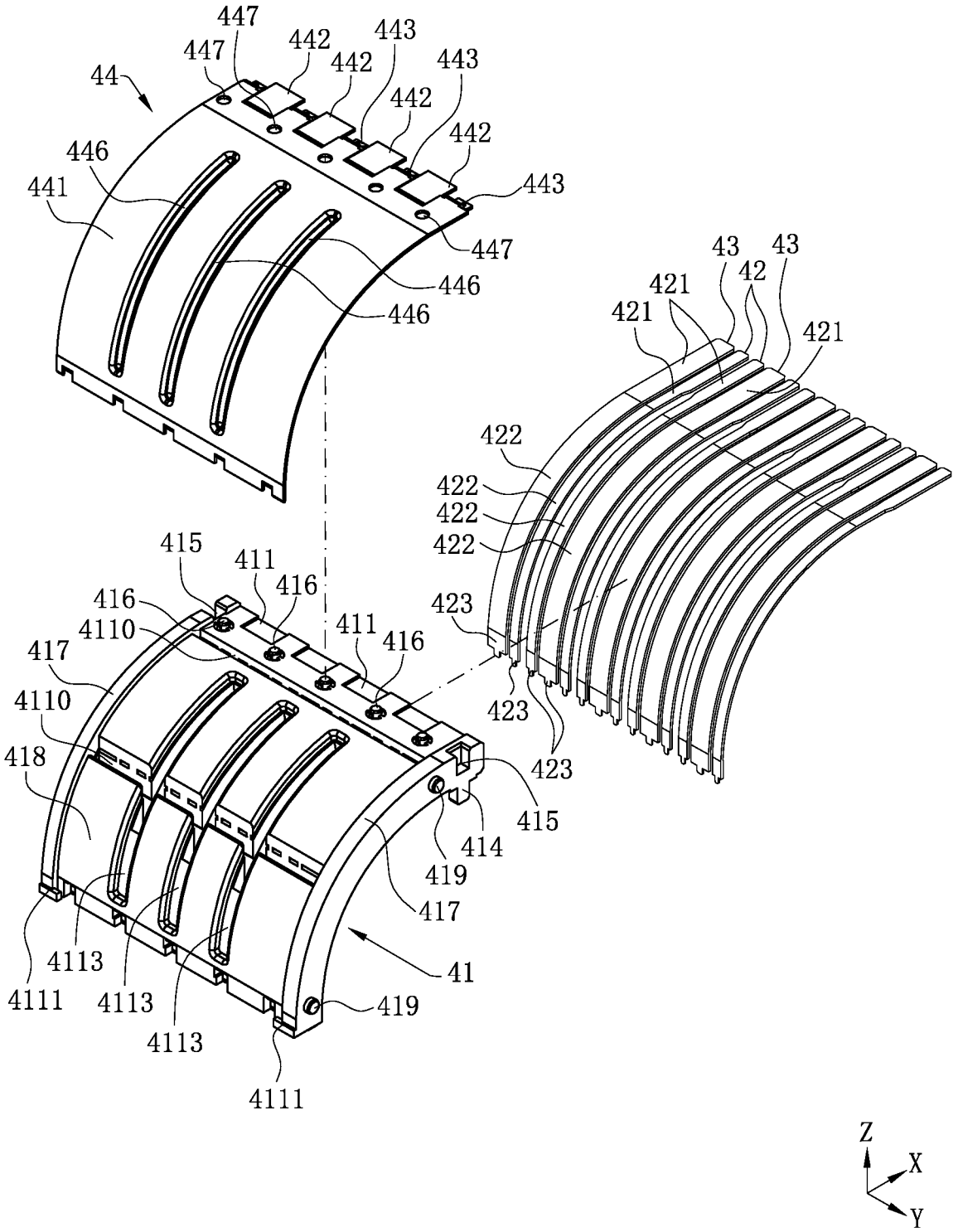
FIG. 16 is a perspective exploded view of an electrical module according to the second embodiment of the present invention.

Referring to FIG. 15 and FIG. 16, in a same electrical module 4, the connecting portions 422 of the first signal conductors and the connecting portions 422 of the first grounding conductors 43 are located on a same arc surface. The insulating block 41 of at least one of the electrical modules 4 has a penetrating slot 4110 provided to run therethrough in the vertical direction Z, and at least one portion of each connecting portion 422 is exposed in the penetrating slot 4110. Thus, comparing to the case where the connecting portions 422 are all wrapped in the insulating block 41, this embodiment increases the contact area of each connecting portion 422 and the air by the penetrating slot 4110, thus reducing the resistance of the first signal conductors, and reducing the signal loss, which is conducive to high frequency signal transmission. Meanwhile, in the injection molding process, it is convenient to perform positioning of the first grounding conductors 43 and the pairs of the first signal conductors 42 in the same electrical module 4 at the location of the penetrating slot 4110 by the upper and lower molds (not shown).

Figure 14:
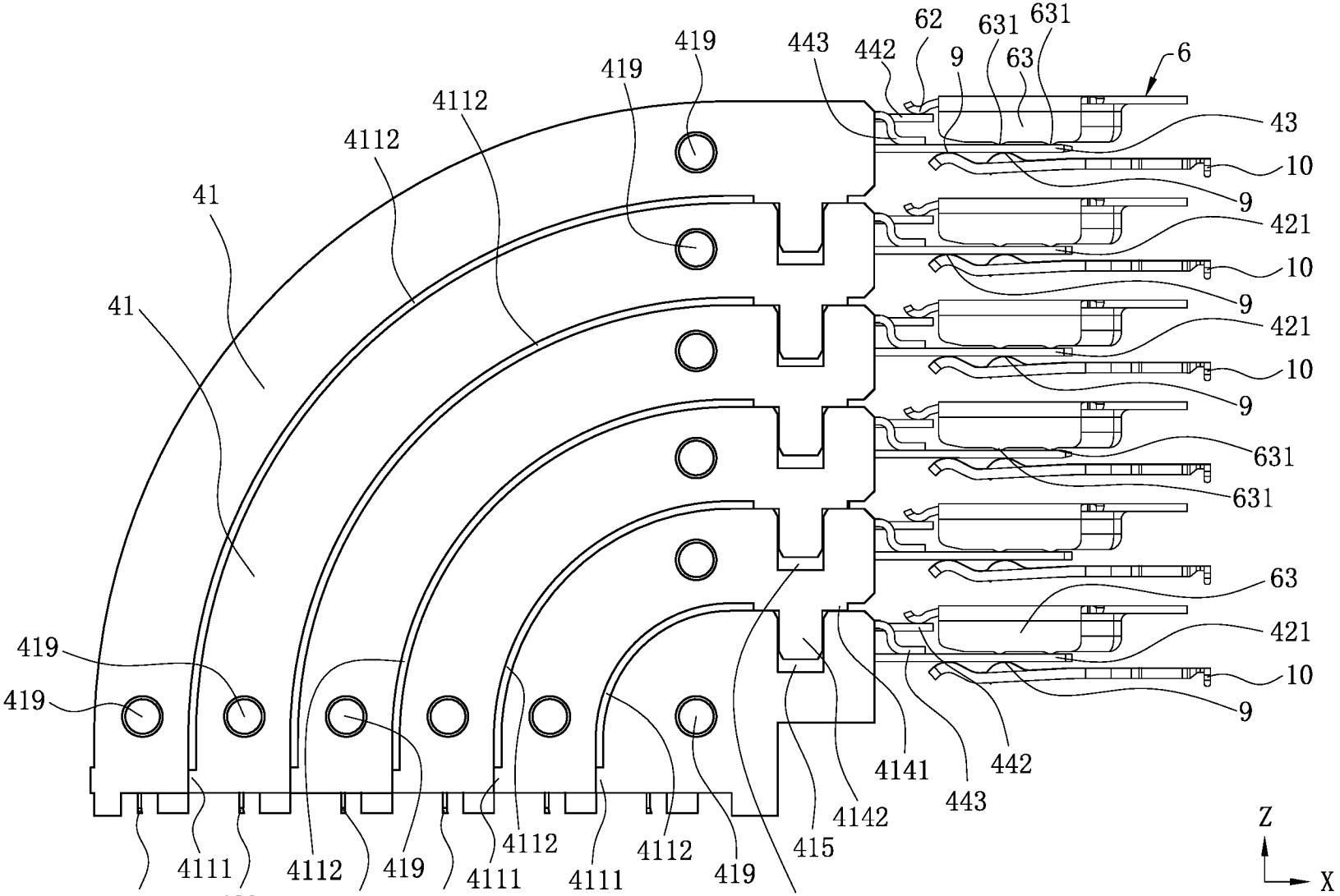
FIG. 14 is a side view of the electrical connector assembly as shown in FIG. 13 in which the insulating mating shell, the insulating rear shell and the insulating body are hidden.

Referring to FIG. 14 to FIG. 16, in the electrical connector 200, there are multiple fixing mechanisms, and any two adjacent electrical modules 4 are provided with a corresponding fixing mechanism. Each fixing mechanism is provided on two insulating blocks 41 of any two adjacent electrical modules 4 stacked vertically, such that the two insulating blocks 41 vertically adjacent to each other are fixed by the fixing mechanism. Each fixing mechanism includes a protruding portion 414 and a positioning slot 415 correspondingly fixing the protruding portion 414, and each insulating block 41 is selectively provided with the protruding portion 414 and/or the positioning slot 415 to match with the positioning slot 415 and/or the protruding portion 414 of the adjacent insulating block 41. Specifically, in this embodiment, for two insulating blocks 41 vertically adjacent to each other, the protruding portion 414 is provided on the insulating block 41 located at the upper side thereof, the positioning slot 415 is provided on the insulating block 41 located at the lower side thereof, and the protruding portion 414 is inserted downward into the positioning slot 415. In other embodiments, the protruding portion 414 may be provided on the insulating block 41 located at the lower side thereof, the positioning slot 415 may be provided on the insulating block 41 located at the upper side thereof, and the protruding portion 414 is inserted upward into the positioning slot 415. Thus, by matching the protruding portions 414 and the positioning slots 415, the two insulating blocks 41 vertically adjacent to each other may be connected and positioned, the assembly thereof is simple and convenient, and matching degree thereof is high, and it is convenient to detach or assemble the electrical modules 4 and to increase or reduce the quantity of the electrical modules 4 based on the actual usage and need, in order to assemble the electrical modules 4 required. It is understandable that, in the electrical modules 4, the electrical module 4 located at the uppermost side may be provided with only the protruding portion 414 or with only the positioning slot 415, and the electrical module 4 located at the lowermost side may be provided with only the positioning slot 415 or with only the protruding portion 414, while the other electrical modules may be provided simultaneously with the protruding portion 414 and the positioning slot 415. In this embodiment, any two adjacent electrical modules 4 are provided with two fixing mechanisms, and the two fixing mechanisms are provided at the left side and the right side of the two adjacent electrical modules 4, such that the two adjacent electrical modules 4 are fixed to each other on at least two locations, thus enhancing the connection stability between the two adjacent electrical modules 4.

Referring to FIG. 14 to FIG. 16, in the two insulating blocks 41 vertical adjacent to each other, the lower arc surface of the insulating block 41 located at the upper side thereof is downward protrudingly provided with the protruding portion 414. The protruding portion 414 includes a first stepping portion 4141 and a protruding leg 4142 sequentially downward from a top thereof. The first stepping portion 4141 abuts the upper arc surface of the insulating block 41 located at the lower side thereof, and a width of the protruding leg 4142 along the front-rear direction X is less than a width of the first stepping portion 4141. The upper arc surface of the insulating block 41 located at the lower side thereof is downward concavely provided with the positioning slot 415. The protruding leg 414 is inserted downward in and fixed to the positioning slot 415 of the insulating block 41 located at the lower side thereof. Thus, after the insulating blocks 41 are formed, when the molds are taken out, the molds may firstly detach from the lower arc surface of the insulating block 41 located at the upper side thereof, and then detach from the first stepping portion 4141, and finally detach from the protruding leg 4142, such that the detaching of the molds and the insulating blocks 41 are gradually transitioning. Thus, comparing to the case where the protruding leg 4142 is provided to directly protrude from the lower arc surface of the insulating block 41 located at the upper side thereof, this embodiment may reduce the probability that the protruding leg 4142 is broken when taking out the molds, thus reducing the defective rate of the electrical modules 4.

Referring to FIG. 14, the upper arc surface of the insulating block 41 located at the lower side thereof is protrudingly provided with a second stepping portion 4111. The second stepping portion 4111 is provided at an end of the insulating block 41 located at the lower side thereof away from the positioning slot 415, and the second stepping portion 4111 abuts the lower arc surface of the adjacent insulating block 41 located at the upper side thereof. In this embodiment, the positioning slot 415 is near a front end of the insulating block 41 located at the lower side thereof, and the second stepping portion 4111 may be near a lower side of a rear end of the insulating block 41 located at the lower side thereof. In other embodiments, the positioning slot 415 may be near the lower side of the rear end of the insulating block 41 located at the lower side thereof, and the second stepping portion 4111 may be near the front end of the insulating block 41 located at the lower side thereof. Thus, by the positions of the first stepping portion 4141 and the second stepping portion 4111, a gap 4112 exists between the two insulating blocks 41 vertically adjacent to each other, thus allowing a certain tolerance to exist in the shape and assembly size of the insulating blocks 41, and preventing the insulating blocks 41 from not matching caused by the inaccurate sizes of the insulating blocks 41 in the manufacturing process or certain deformations occurring to the insulating blocks 41 during the injection molding process. Meanwhile, in the case where the first stepping portion 4141 and the second stepping portion 4111 are provided on the same insulating block 41, the insulating block 41 is arc-shaped, and when the forming of the insulating block 41 is completed and the molds are taken out, the first stepping portion 4141 and the second stepping portion 4111 located on the same insulating block 41 will limit each other, thus resulting in difficulty for taking out the molds. Therefore, in this embodiment, by providing the first stepping portion 4141 and the second stepping portion 4111 respectively on the two insulating blocks 41 vertically adjacent to each other, it is conducive to taking out the molds from the arc-shaped insulating blocks 41, thus enhancing the efficiency of the production manufacturing process. Further, by providing the second stepping portion 4111, the abutting force between the two adjacent electrical modules 4 may be increased, thus preventing the pairs of first signal conductors from not accurately mating with the mating connector 300 caused by the relative shaking of the two adjacent electrical modules 4.

Figure 17:
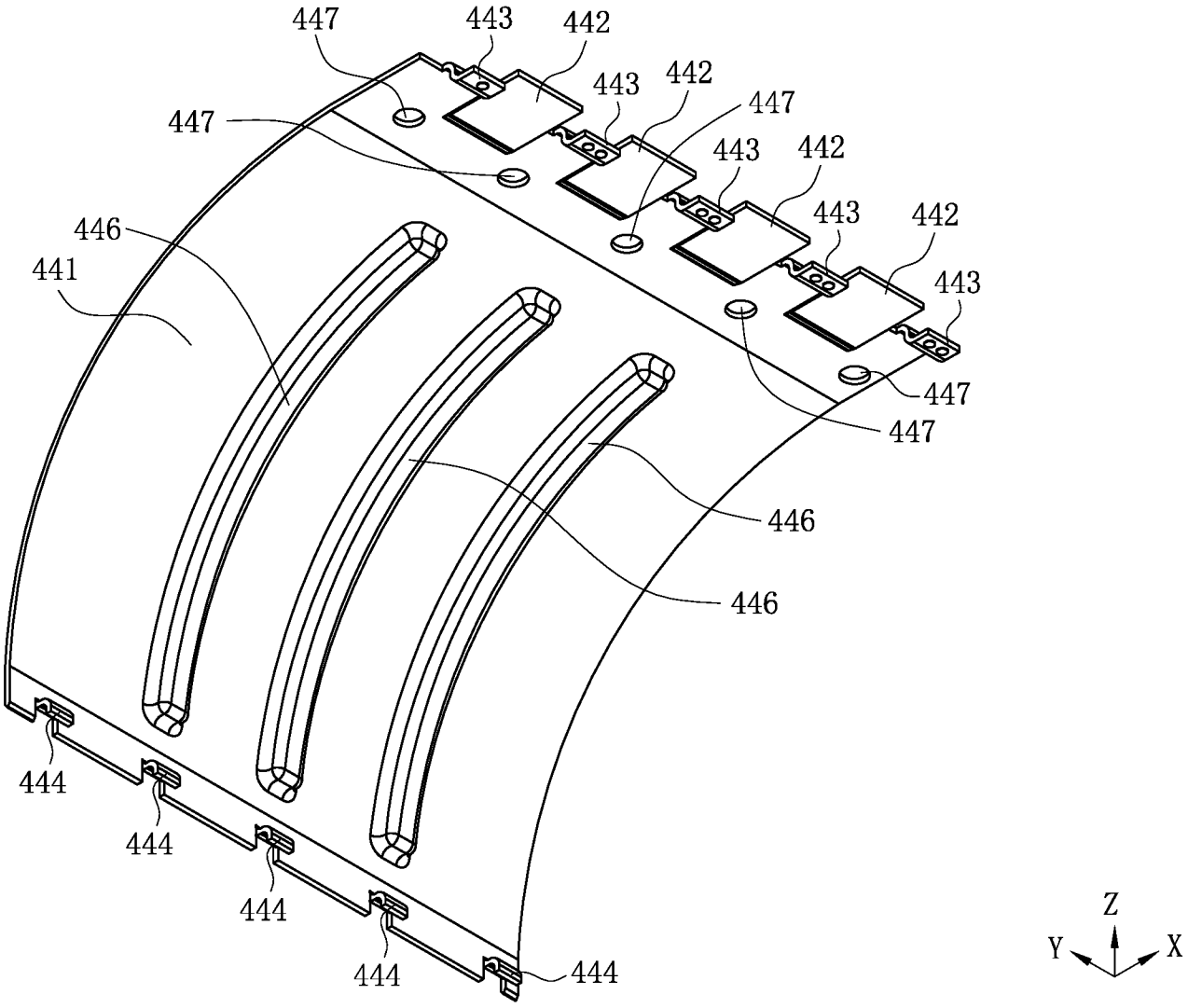
FIG. 17 is a perspective view of a first shielding member of the electrical connector according to the second embodiment of the present invention.

Referring to FIG. 16 and FIG. 17, in each electrical module 4, the first shielding member 44 includes a first main body portion 441 provided to cover an upper arc surface of the insulating block 41. The first main body portion 441 is provided with a plurality of elongated ribs 446 protruding toward the first grounding conductors 43, and each elongated rib 446 is in contact with the connecting portion 422 of a corresponding one of the first grounding conductors 43. Thus, the first shielding member 44 is in contact with the connecting portions 422 of the first grounding conductors 43 through the elongated ribs 446, thus increasing the contact areas between the first shielding member 44 and the first grounding conductors 43, and enhancing the contact stability between the first shielding member 44 and the first grounding conductors 43.

Referring to FIG. 16 and FIG. 17, in each electrical module 4, the first shielding member 44 is fixed to the upper arc surface of the insulating block 41. The upper arc surface is downward concavely provided with a plurality of elongated slot portions 4113 to expose the connecting portions 422 of the first grounding conductors 43, and each elongated slot portion 4113 matches and accommodates a corresponding one of the elongated ribs 446. Thus, by matching the elongated slot portions 4113 and the elongated ribs 446, the first shielding member 44 may be fixed and position limited to the insulating block 41. It should be noted that the first mating portions 442, the first grounding portions 443, the second grounding portions 444 or the elongated ribs 446 of each first shielding member 44 do not need to be provided in plurality. In other embodiments, it is possible to provide one first mating portion 442, one first grounding portion 443, one second grounding portion 444 or one elongated rib 446 in each first shielding member 44, and each quantity may be provided according to actual needs.

Referring to FIG. 15 and FIG. 16, in each electrical module 4, the first shielding member 44 is provided to cover the upper arc surface of the insulating block 41, and two position limiting portions 417 are provided to protrude upward from a left end and a right end of the upper arc surface of the insulating block 41, in order to form a recess portion 418 between the two position limiting portions 417 to accommodate the first shielding member 44. Thus, the first shielding member 44 is accommodated in the recess portion 418, and the first shielding member 44 is stopped by the two position limiting portions 417 in the left-right direction, which may prevent the first shielding member 44 from sliding out from the left side and the right side of the insulating block 41.

Referring to FIG. 16 and FIG. 17, in each electrical module 4, the first grounding portions 443 are formed by bending and extending from a front end of the first main body portion 441 of the first shielding member 44 toward upper surfaces of the first grounding conductors 43, and the first grounding portions 443 are in contact with the upper surfaces of the first grounding conductors 43. The front end of the first main body portion 441 extends forward to form the first mating portions 442 to be in contact with the second mating portions 62 of the mating connector 300. The first mating portions 442 and the first grounding portions 443 are provided to be adjacent in the left-right direction. Specifically, one of the first mating portions 442 is provided between two adjacent first grounding portions 443 in the left-right direction. A plurality of clamping protruding portions 416 are provided to protrude upward from the upper arc surface of the insulating block 41, and the first main body portion 441 of the first shielding member 44 is provided with a plurality of clamping through holes 447 to accommodate the corresponding clamping protruding portions 416. The first mating portions 442 of the first shielding member 44 are respectively located right above the pairs of first signal conductors 42, and the clamping protruding portions 416 are respectively located right above the first grounding conductors 43. The clamping through holes 447 directly face the first grounding conductors 43 in the vertical direction Z, and the clamping through holes 447 are provided to be staggered with the first mating portions 442 in the left-right direction Y. Thus, the first shielding member 44 is fixed to the insulating block 41 through the clamping protruding portions 416 and the clamping through holes 447, thus preventing the first shielding member 44 from moving and erroneously contacting the first signal conductors, and facilitating normal usage of the electrical connector 200. Meanwhile, the clamping through holes 447 do not directly face the pairs of first signal conductors 42, thus preventing the shielding effect of the first shielding member 44 to the pairs of first signal conductors 42 from being reduced due to the provision of the clamping through holes 447. Further, the clamping protruding portions 416 are respectively located right above the first grounding conductors 43, and the clamping through holes 447 are located right behind the first grounding portions 443 and are adjacent to the first grounding portions 443 in the front-rear direction X, such that after the clamping through hole 447 and the clamping protruding blocks 416 match with each other, the first grounding portions 443 do not easily separate from the first grounding conductors 43, thereby enhancing the contact stability between the first grounding portions 443 and the first grounding conductors 43.

Referring to FIG. 15, multiple insertion slots 161 are formed by being outward concavely provided on an inner wall of each extending wall 16, and at least one insertion bar 702 is formed by protruding outward from each of a left side wall and a right side wall of the insulating rear shell 700. The insertion bar 702 is inserted into a corresponding insertion slot 161 such that the insulating rear shell 700 is detachably assembled forward to the insulating mating shell 1 from a rear thereof. Thus, the insulating mating shell 1 and the insulating rear shell 700 may be assembled by the insertion slots 161 and the insertion bars 702, which is convenient for the electrical connector 200 to perform detaching and maintenance or replacing components thereof.

Referring to FIG. 14 and FIG. 15, at least one insertion block 419 is provided to protrude outward from each of a left side wall and a right side wall of each insulating block 41. Each insertion block 419 is inserted into a corresponding insertion slot 161, and is stopped by a front end surface 1611 of a lower end surface 1612 of the corresponding insertion slot 161. Specifically, the insertion blocks 419 provided on the electrical modules 4 have a first row arranged along the vertical direction Z and a second row arranged along the left-right direction Y. Each insertion block 419 in the first row is provided at a location adjacent to the front end of the corresponding insulating block 41, and each insertion block 419 in the second row is provided at a location adjacent to the lower end of the corresponding insulating block 41. Thus, this embodiment facilitates assembling the electrical modules 4 to the insulating mating shell 1 by inserting the insertion blocks 419 of the insulating blocks 41 to the corresponding insertion slots 161, and each insertion block 419 is stopped by the front end surface 1611 or the lower end surface 1612 of the corresponding insertion slot 161, thus preventing the electrical modules 4 from sliding forward or downward relative to the insulating mating shell 1, and fixing the electrical modules 4 to the insulating mating shell 1.

Figure 18:
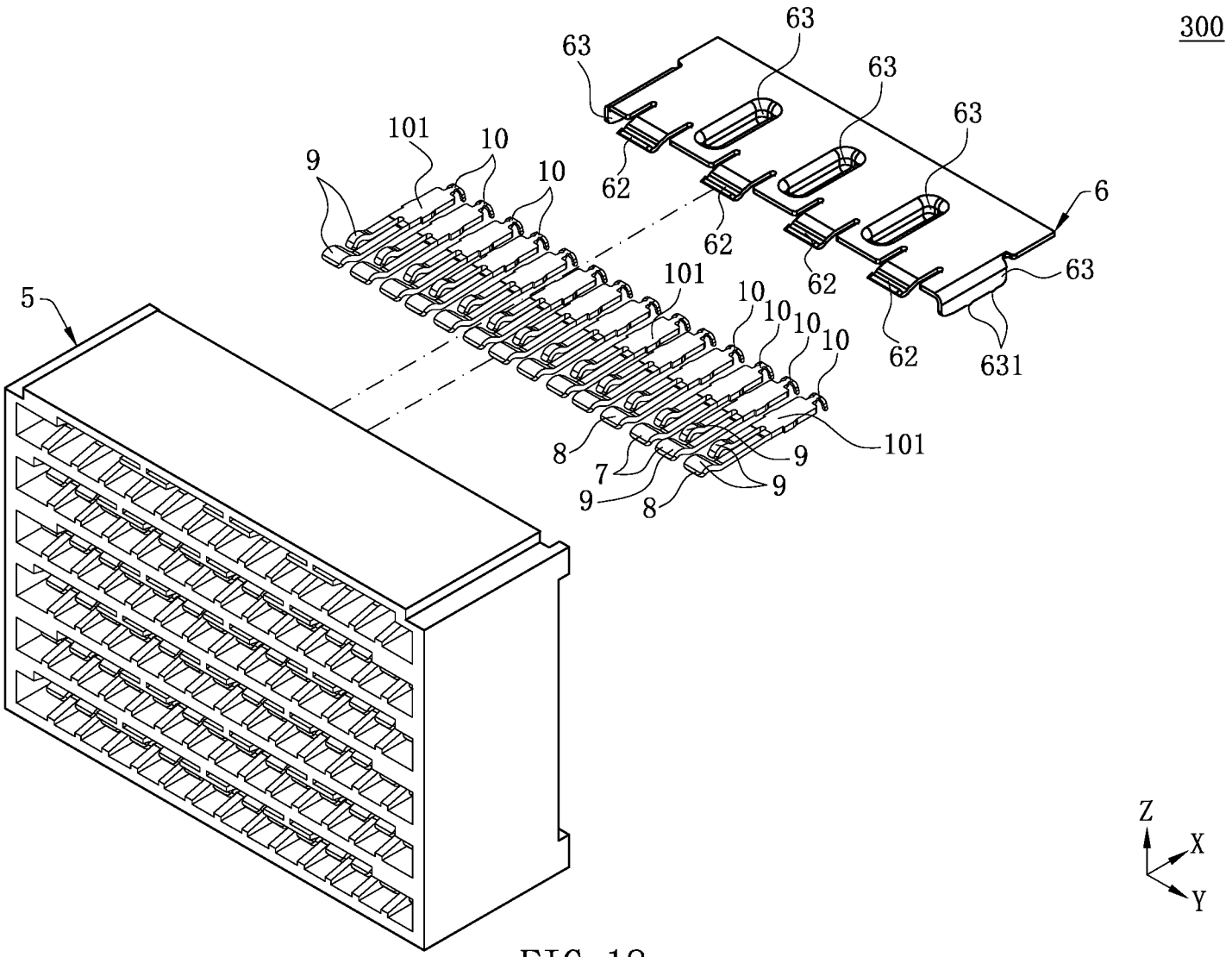
FIG. 18 is a perspective exploded view of the mating connector according to the second embodiment of the present invention.

FIG. 18 shows a mating connector 300 provided by the second embodiment of the present invention. The mating connector 300 includes an insulating body 5, a plurality of second shielding member 6 fixed to the insulating body 5, and a plurality of second grounding conductors 8 and a plurality of pairs of second signal conductors 7 alternately arranged along the left-right direction and fixed to the insulating body 5. The second grounding conductors 8 and the pairs of second signal conductors 7 are arranged as a plurality of rows of conductors. Each pair of the second signal conductors 7 includes two second signal conductors, and each of a left side and a right side of each pair of the second signal conductors 7 is provided with one of the second grounding conductors 8. Each second shielding member 6 has a second main body portion 61 shielding above a corresponding pair of the second signal conductors 7, and a plurality of second mating portions 62 extends backward from the second main body portion 62 to mate with the first mating portions 442 of a corresponding one of the first shielding members 44. When the mating of the electrical connector 200 and the mating connector 300 is completed, each pair of the first signal conductors 42 is one-to-one correspondingly in contact with each pair of the second signal conductors 7, each first grounding conductor 43 is one-to-one correspondingly in contact with each second grounding conductor 8, and each first shielding member 44 is one-to-one correspondingly in contact with each second shielding member 6. Each second grounding conductor 8 and each second signal conductor in each pair of the second signal conductors 7 have two second contact portions 9, a second conductive portion 10 and a horizontal portion 101 connected to the second contact portions 9 and the second conductive portion 10.

Each second shielding member 6 is provided with a plurality of third grounding portions 63, and the third grounding portions 63 are respectively in contact with the second grounding conductors 8. Two of the third grounding portions 63 are formed by bending from the left side and right side of each second shielding member 6 and extending toward two of the second grounding conductors 8 respectively, and multiple third grounding portions 63 in rib shapes are formed by protrudingly provided from a center portion of each second shielding member 6 toward at least one corresponding second grounding conductor 8. The center portion of each second shielding member 6 is the portion located between the left side and the right side of the second shielding member 6. Further, each of the two third grounding portions 63 located at the left side and right side of each second shielding member 6 has two contact protrusions 631. The contact protrusions 631 are provided to protrude downward from a lower end surface of the corresponding third grounding portion 63 to be in contact with the corresponding second grounding conductor 8, and the two contact protrusions 631 are provided at intervals along the front-rear direction.

In sum, the electrical connector and the electrical connector assembly according to certain embodiments of the present invention have the following beneficial effects:

1. In the electrical connector 200, the two first signal conductors in each pair of first signal conductors 42 have the same length, thus facilitating the coupling between the two first signal conductors in each pair of first signal conductors 42, and each pair of first signal conductors 42 bends to be arc-shaped without bending angles, such that the extending direction of each pair of first signal conductors 42 gradually transitions and bends, and the extending direction of each pair of first signal conductors 42 does not suddenly turn and bend, thereby allowing the signal loss to be relatively small and shortening the signal transmission path thereof, thus facilitating high frequency signal transmission. The electrical modules 4 are sequentially stacked along the vertical direction, and each insulating block 41 is arc-shaped, thus facilitating the mutual position limiting of the electrical modules 4 in the vertical direction Z and the front-rear direction X without easy displacement therebetween. Further, the first grounding conductors 43 and the pairs of first signal conductors 42 are arranged alternately along the left-right direction Y, and the first main body portion 441 of the first shielding member 44 overlaps with the projection of at least one pair of the pairs of first signal conductors 42 in the vertical direction Z, such that the first shielding member 44 may perform signal shielding to the pairs of first signal conductors 42 in the vertical direction Z, and the first grounding conductors 43 may perform signal shielding to the pairs of first signal conductors 42 in the left-right direction Y, thus multi-directionally reducing the interference caused by the interfering signals to each pair of the first signal conductors 42. The first shielding member 44 is electrically connected to each first grounding conductor 43 through the first grounding portion 443, allowing the mutual connection and grounding of the first shielding member 44 and the first grounding conductors 43, and improving the high frequency characteristics of the electrical connector 200. Further, the first contact portions 421 of the row of conductors located on the same one of the electrical modules 4 are located on a same horizontal plane, which is convenient for mating with the mating connector 300, thus ensuring stable mating effect, and allowing the row of conductors to be formed by punching together, and in injection-molding the insulating block 41, the injection mold uniformly fixes the first contact portions 421 of the row of conductors. Further, in the electrical connector assembly 100, the first mating portion 441 of the first shielding member 44 and the second mating portion 62 of the second shielding member 6 are electrically connected, thus increasing the grounding paths of the first shielding member 44, preventing the first shielding member 44 from being in unstable contact with the first grounding conductors 43 and affecting the shielding effect of the first shielding member 44, and facilitating the effective shielding of the first shielding member 44 to the pairs of first signal conductors 42, which is conducive to the high frequency signal transmission of the pairs of first signal conductors 42.

2. In the electrical connector 200, the fixing mechanism includes the protruding portion 414 and the positioning slot 415 correspondingly matching the protruding portion 414, such that the two insulating blocks 41 vertically adjacent to each other may be connected and positioned, the assembly thereof is simple and convenient, and matching degree thereof is high, and it is convenient to detach or assemble the electrical modules 4 and to increase or reduce the quantity of the electrical modules 4 based on the actual usage and need, in order to assemble the electrical modules 4 required.

3. The protruding portion 414 includes a first stepping portion 4141 and a protruding leg 4142 sequentially downward from a top thereof. The first stepping portion 4141 abuts the upper arc surface of the insulating block 41 located at the lower side thereof, and a width of the protruding leg 4142 along the left-right direction Y is less than a width of the first stepping portion 4141, which may reduce the probability that the protruding leg 4142 is broken when taking out the molds, thus reducing the defective rate of the electrical modules 4.

4. By the first stepping portion 4141 and the second stepping portion 4111, a gap 4112 exists between the two insulating blocks 41 vertically adjacent to each other, thus allowing a certain tolerance to exist in the shape and assembly size of the insulating blocks 41, and preventing the insulating blocks 41 from not matching caused by the inaccurate sizes of the insulating blocks 41 in the manufacturing process or certain deformations occurring to the insulating blocks 41 during the injection molding process. Meanwhile, by providing the first stepping portion 4141 and the second stepping portion 4111 respectively on the two insulating blocks 41 vertically adjacent to each other, it is conducive to taking out the molds from the arc-shaped insulating blocks 41, thus enhancing the efficiency of the production manufacturing process. Further, by providing the second stepping portion 4111, the abutting force between the two adjacent electrical modules 4 may be increased, thus preventing the pairs of first signal conductors from not accurately mating with the mating connector 300 caused by the relative shaking of the two adjacent electrical modules 4.

5. The first main body portion 441 of the first shielding member 44 is provided with the elongated ribs 446 to be in contact with the connecting portions 422 of the first grounding conductors 43, thus increasing the contact areas between the first shielding member 44 and the first grounding conductors 43, and enhancing the contact stability between the first shielding member 44 and the first grounding conductors 43. Further, the ribs 446 are accommodated in the elongated slot portions 4113 of the insulating block 41, facilitating further fixing and limiting the position of the first shielding member 44 to the insulating block 41.

6. The insertion bar 702 of the insulating rear shell 700 is inserted into the corresponding insertion slot 161 of insulating mating shell 1, such that the insulating rear shell 700 is detachably assembled to the insulating mating shell 1 from a rear thereof, which is convenient for the electrical connector 200 to perform detaching and maintenance or replacing components thereof.

7. At least one first mating portion 442 is formed by extending forward from the front end of the first main body portion 441 to be in contact with the first mating connector 300, thus increasing the grounding paths of the first shielding member 44, and preventing the first shielding member 44 from being in unstable contact with the first grounding conductors 43 and affecting the shielding effect of the first shielding member 44. Further, the first grounding portions 443 and the first mating portion 442 all extend from the front end of the first main body portion 441, which reduces the material used for the first shielding member 44, and the first mating portion 443 and the second mating portion 444 are respectively formed by extending from the front end and the lower end of the first main body portion 441, which may be in contact with different areas of the first grounding conductors 43, further enhancing the contact stability between the first shielding member 44 and the first grounding conductors 43.

8. By matching the clamping protruding portions 416 and the clamping through holes 447, the first shielding member 44 is fixed to the insulating block 41. In addition, the clamping protruding portions 416 are respectively located right above the first grounding conductors 43, the clamping through holes 447 directly face the first grounding conductors 43 in the vertical direction, the first mating portions 442 are located right above the pairs of first signal conductors 42, and the clamping through holes 447 are provided to be staggered with the first mating portions 442 in the left-right direction Y, thus preventing the shielding effect of the first shielding member 44 to the pairs of first signal conductors 42 from being reduced due to the provision of the clamping through holes 447. Further, the clamping protruding portions 416 are located right above the first grounding conductors 43, and the clamping through holes 447 are located right behind the first grounding portions 443 and are adjacent to the first grounding portions 443 in the front-rear direction X, such that the first grounding portions 443 do not easily separate from the first grounding conductors 43, thereby enhancing the contact stability between the first grounding portions 443 and the first grounding conductors 43.

9. In the same one of the electrical modules 4, the pairs of first signal conductors 42 and the first grounding conductors 43 are injection-molded once together with the same insulating block 41 to form an integral structure altogether, and dielectric coefficients of the insulating block 41 at different locations are identical. Thus, the first grounding conductors 43 and the pairs of first signal conductors 42 are injection-molded once to bend to be arc-shaped, which do not need to go through second punching and bending, thus saving the production cost and enhancing the efficiency of the production manufacturing process. Meanwhile, the dielectric coefficients of the insulating block 41 at different locations are identical, which facilitates the high frequency signal transmission of the pairs of first signal conductors 42.

10. The connecting portions 422 of the conductors of the same one of the electrical modules 4 are located on a same arc surface, and the first conductive portions 423 of the conductors of the same one of the electrical modules 4 are located on a same plane, such that the electrical coupling effect of all locations of each pair of the first signal conductors 42 is better, which is more conducive to adjusting the impedance to achieve more preferred high frequency transmission effect. Further, the insulating block 41 has a penetrating slot 4110 provided to run therethrough in the vertical direction Z, and at least one portion of the connecting portions 422 of each pair of the first signal conductors 42 is exposed in the penetrating slot 4110, thus reducing the resistance of the pairs of the first signal conductors 42, which is conducive to high frequency signal transmission, and is convenient for the injection mold to perform positioning of the first grounding conductors 43 and the pairs of the first signal conductors 42 in the same electrical module 4.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a plurality of electrical modules sequentially stacked along a vertical direction and fixed by at least one fixing mechanism, wherein each of the electrical modules comprises an insulating block being arc-shaped, a row of conductors fixed to the insulating block and arranged along a left-right direction perpendicular to the vertical direction, and at least one first shielding member provided to cover the insulating block, a front-rear direction is defined to be perpendicular to the vertical direction and the left-right direction, the first shielding member and each of the conductors bend and extend downward from a top thereof and backward from a front thereof to be arc-shaped, each of the conductors comprises a first contact portion, a first conductive portion and a connecting portion connected to the first contact portion and the first conductive portion, and the first contact portions of the row of conductors located on the same one of the electrical modules are located on a same horizontal plane;

wherein the row of conductors comprises a plurality of first grounding conductors and a plurality of pairs of first signal conductors arranged alternately along the left-right direction, and the two first signal conductors in a same pair of the pairs of first signal conductors have a same length; and wherein the first shielding member has a first main body portion overlapping with a projection of at least one pair of the pairs of first signal conductors in the vertical direction, and at least one first grounding portion extending from the first main body portion to be electrically connected to at least one of the first grounding conductors.

2. The electrical connector according to claim 1, wherein the fixing mechanism is provided on two adjacent insulating blocks of any two adjacent ones of the electrical modules stacked vertically to fix the two adjacent insulating blocks, the fixing mechanism comprises a protruding portion and a positioning slot correspondingly fixing the protruding portion, and each of the two adjacent insulating blocks is selectively provided with the protruding portion and/or the positioning slot to match with the positioning slot and/or the protruding portion of the other of the two adjacent insulating blocks.

3. The electrical connector according to claim 2, wherein of the two adjacent insulating blocks, a lower arc surface of the insulating block located at an upper side thereof is downward protrudingly provided with the protruding portion, the protruding portion comprises a first stepping portion and a protruding leg sequentially downward from a top thereof, the first stepping portion abuts an upper arc surface of the insulating block located at a lower side thereof, a width of the protruding leg along the front-rear direction is less than a width of the first stepping portion, the upper arc surface of the insulating block located at the lower side thereof is downward concavely provided with the positioning slot, and the protruding leg is inserted downward in and fixed to the positioning slot of the insulating block located at the lower side thereof.

4. The electrical connector according to claim 3, wherein an end of the upper arc surface of the insulating block located at the lower side thereof away from the positioning slot is protruding provided with a second stepping portion, and the second stepping portion abuts the lower arc surface of the adjacent insulating block located at the upper side thereof.

5. The electrical connector according to claim 1, wherein the fixing mechanism comprises two fixing plates and at least two protruding blocks provided on each of the insulating blocks of the electrical modules, the two fixing plates are respectively located at a left side and a right side of the electrical modules, and the two protruding blocks are respectively provided to protrude outward from a left side and a right side of each of the insulating blocks;

inner surfaces of the two fixing plates are provided to be opposite to each other along the left-right direction, at least one fixing slot is formed by being outward concavely provided on each of the inner surfaces of the two fixing plates, and each of the at least one fixing slot correspondingly accommodates one of the protruding blocks.

6. The electrical connector according to claim 1, wherein the first main body portion is provided with at least one elongated rib protruding toward at least one of the first grounding conductors, and the elongated rib is in contact with the connecting portion of a corresponding one of the first grounding conductors.

7. The electrical connector according to claim 6, wherein the first shielding member is fixed to an upper arc surface of the insulating block, the upper arc surface is downward concavely provided with at least one elongated slot portion to expose the connecting portion of at least one of the first grounding conductors, and the at least one elongated slot portion matches and accommodates a corresponding one of the at least one elongated rib.

8. The electrical connector according to claim 1, wherein the connecting portions of the conductors of a same one of the electrical modules are located on a same arc surface, the first conductive portions of the same one of the electrical modules are located on a same plane, the insulating block of at least one of the electrical modules has a penetrating slot provided to run vertically therethrough, and at least one portion of each of the connecting portions of each pair of the pairs of first signal conductors is exposed in the penetrating slot.

9. The electrical connector according to claim 1, wherein the electrical connector has an insulating mating shell, a front end of the insulating mating shell has a mating cavity to accommodate each of the first contact portion, a rear end of the insulating mating shell has two extending walls connected to the mating cavity and respectively provided at a left side and a right side of the insulating block, and an insertion slot is outward concavely provided on an inner surface of each of the two extending walls;

the electrical connector has an insulating rear shell located behind the mating cavity, the insulating rear shell has a reserved space reserved for the electrical modules, at least one insertion bar is provided to protrude outward from each of a left side wall and a right side wall of the insulating rear shell, the insertion bar is inserted into a corresponding one of the insertion slots of the two extending walls such that the insulating rear shell is detachably assembled forward to the insulating mating shell from a rear thereof.

10. The electrical connector according to claim 9, wherein each of the extending walls has a plurality of insertion slots, at least one insertion block is provided to protrude outward from each of a left side wall and a right side wall of each of the insulating blocks of the electrical modules, each of the at least one insertion block is inserted into a corresponding one of the insertion slots, and each of the at least one insertion block is stopped by a front end surface or a lower end surface of the corresponding one of the insertion slots.

11. The electrical connector according to claim 1, wherein in each of the electrical modules, the first shielding member is provided to cover an upper arc surface of the insulating block, two position limiting portions are provided to protrude upward from a left end and a right end of the upper arc surface of the insulating block, and a recess portion is formed between the two position limiting portions to accommodate the first shielding member.

12. The electrical connector according to claim 1, wherein the first main body portion is provided to cover an upper arc surface of the insulating block, the first grounding portion bends and extends toward an upper surface of a corresponding one of the first grounding conductors from a front end of the first main body portion, the front end of the first main body portion extends forward to form at least one first mating portion to be in contact with a mating connector, and the first grounding portion and the first mating portion are provided to be adjacent to each other in the left-right direction;

at least one second grounding portion is formed by bending and extending toward at least one of the first grounding conductors from a lower end of the first main body portion, and the second grounding portion is electrically connected to a corresponding one of the first grounding conductors.

13. The electrical connector according to claim 12, wherein in each of the electrical modules, the first main body portion is provided to cover the upper arc surface of the insulating block, at least one clamping protruding portion is provided to protrude upward from the upper arc surface of the insulating block, and the first main body portion is provided with at least one clamping through hole to accommodate the corresponding at least one clamping protruding portion;

the clamping protruding portion is located right above the corresponding one of the first grounding conductors, the clamping through hole directly faces the corresponding one of the first grounding conductors in the vertical direction, the first mating portion is located right above a corresponding pair of the pairs of the first signal conductors, and the clamping through hole is provided to be staggered with the first mating portion in the left-right direction.

14. The electrical connector according to claim 1, wherein in a same one of the electrical modules, the first signal conductors and the first grounding conductors are injection-molded once together with the insulating block to form an integral structure, and dielectric coefficients of the insulating block at different locations are identical.

15. An electrical connector assembly, comprising:

an electrical connector, comprising a plurality of electrical modules sequentially stacked along a vertical direction and fixed by at least one fixing mechanism, wherein each of the electrical modules comprises an insulating block being arc-shaped, a row of conductors fixed to the insulating block and arranged along a left-right direction perpendicular to the vertical direction, and at least one first shielding member provided to cover the insulating block, a front-rear direction is defined to be perpendicular to the vertical direction and the left-right direction, the first shielding member and each of the conductors bend and extend downward from a top thereof and backward from a front thereof to be arc-shaped, each of the conductors comprises a first contact portion, a first conductive portion and a connecting portion connected to the first contact portion and the first conductive portion, and the first contact portions of the row of conductors located on the same one of the electrical modules are located on a same horizontal plane; wherein the row of conductors comprises a plurality of first grounding conductors and a plurality of pairs of first signal conductors arranged alternately along the left-right direction, and the two first signal conductors in a same pair of the pairs of first signal conductors have a same length; and wherein the first shielding member is electrically connected to at least one of the first grounding conductors, the first shielding member has a first main body portion located above at least one pair of the pairs of first signal conductors, and at least one first mating portion extends forward from the first main body portion; and a mating connector, configured to mate with the electrical connector, wherein the mating connector has an insulating body, a plurality of second grounding conductors and a plurality of pairs of second signal conductors arranged alternately on the insulating body, and at least one second shielding member fixed to the insulating body; each of the second grounding conductors and each of the second signal conductors in each pair of the pairs of second signal conductors has at least one second contact portion to be in contact with a corresponding one of the first contact portion, and a second conductive portion to be in contact with a circuit board and located in front of the second contact portion; the second shielding member is electrically connected to at least one of the second grounding conductors, the second shielding member has a second main body portion shielding above the pairs of second signal conductors, and a second mating portion extends backward from the second main body portion;

wherein when the mating connector is inserted into the electrical connector and electrically connected to the pairs of first signal conductors, the second mating portion is electrically connected to the first mating portion, the second contact portion of each of the second signal conductors is electrically connected to the first contact portion of a corresponding one of the first signal conductors, and the second contact portion of each of the second grounding conductors is electrically connected to the first contact portion of a corresponding one of the first grounding conductors.

* * * * *